US011790855B2

(12) United States Patent
Choi et al.

(10) Patent No.: US 11,790,855 B2
(45) Date of Patent: Oct. 17, 2023

(54) DISPLAY DEVICE INCLUDING PIXELS DRIVEN AT DIFFERENT FREQUENCIES AND DRIVING METHOD THEREOF

(71) Applicant: Samsung Display Co., Ltd., Yongin-si (KR)

(72) Inventors: Yang-Hwa Choi, Hwaseong-si (KR); Hyuk Kim, Suwon-si (KR); Junghwan Hwang, Seongnam-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/720,907

(22) Filed: Apr. 14, 2022

(65) Prior Publication Data

US 2022/0343857 A1 Oct. 27, 2022

(30) Foreign Application Priority Data

Apr. 23, 2021 (KR) ..... 10-2021-0052928

(51) Int. Cl.
*G09G 3/30* (2006.01)
*G09G 3/3266* (2016.01)
(Continued)

(52) U.S. Cl.
CPC ..... *G09G 3/3266* (2013.01); *G09G 3/3225* (2013.01); *G09G 3/3233* (2013.01); *G09G 3/3258* (2013.01); *G09G 3/3291* (2013.01); *G09G 2300/0417* (2013.01); *G09G 2300/0842* (2013.01); *G09G 2310/021* (2013.01);
(Continued)

(58) Field of Classification Search
CPC ..... G09G 3/3266; G09G 2310/0286; G09G 2310/08; G09G 3/3225; G09G 3/3258; G09G 3/3233; G09G 3/3291; G09G 2300/0417; G09G 2300/0842; G09G 2310/021; G09G 2310/0251; G09G 2310/0243; G09G 2310/061; G09G 2320/0233; G09G 2320/0247;
(Continued)

(56) References Cited

U.S. PATENT DOCUMENTS 9,320,967 B2 4/2016 Knutsson
10,803,810 B2 10/2020 Takasugi
(Continued)

FOREIGN PATENT DOCUMENTS

KR 1020180127896 A 11/2018
KR 1020200029178 A 3/2020
(Continued)

*Primary Examiner* — Adam J Snyder
(74) *Attorney, Agent, or Firm* — CANTOR COLBURN LLP

(57) ABSTRACT

A display device includes a plurality of pixels connected to a plurality of first scan lines, a plurality of second scan lines, and a plurality of data lines, where the pixels are arranged in a plurality of rows, a plurality of first stages connected to the first scan lines, a plurality of second stages connected to the second scan lines, and a data driver connected to the data lines. Each of the first scan lines is connected to pixels arranged in a corresponding row among the rows. Each of the second scan lines is commonly connected to pixels arranged in corresponding 8h rows among the plurality of rows, where h is a natural number.

19 Claims, 24 Drawing Sheets

(51) Int. Cl.

| | |
|---|---|
| *G09G 3/3225* | (2016.01) |
| *G09G 3/3258* | (2016.01) |
| *G09G 3/3233* | (2016.01) |
| *G09G 3/3291* | (2016.01) |

(52) U.S. Cl.
CPC ..... *G09G 2310/0243* (2013.01); *G09G 2310/0251* (2013.01); *G09G 2310/0286* (2013.01); *G09G 2310/061* (2013.01); *G09G 2310/08* (2013.01); *G09G 2320/0233* (2013.01); *G09G 2320/0247* (2013.01); *G09G 2320/0261* (2013.01); *G09G 2320/0295* (2013.01); *G09G 2320/043* (2013.01)

(58) Field of Classification Search
CPC ... G09G 2320/0261; G09G 2320/0295; G09G 2320/043; G09G 2340/0435
See application file for complete search history.

(56) References Cited

U.S. PATENT DOCUMENTS

| | | | | |
|---|---|---|---|---|
| 10,891,903 | B2 | 1/2021 | Takasugi | |
| 11,037,506 | B2 | 6/2021 | Noh et al. | |
| 2010/0079361 | A1* | 4/2010 | Lee | G09G 3/3233 345/77 |
| 2016/0321983 | A1* | 11/2016 | Kim | G09G 3/2092 |
| 2017/0316738 | A1* | 11/2017 | Sohn | G09G 3/3266 |
| 2020/0074933 | A1* | 3/2020 | Ban | G09G 3/3266 |
| 2021/0193028 | A1* | 6/2021 | Choi | G09G 3/3233 |

FOREIGN PATENT DOCUMENTS

| | | | |
|---|---|---|---|
| KR | 1020200075945 | A | 6/2020 |
| KR | 1020200077929 | A | 7/2020 |

* cited by examiner

[TP1]

[TP2]

[TP3]

DISPLAY DEVICE INCLUDING PIXELS DRIVEN AT DIFFERENT FREQUENCIES AND DRIVING METHOD THEREOF

This application claims priority to Korean Patent Application No. 10-2021-0052928, filed on Apr. 23, 2021, and all the benefits accruing therefrom under 35 U.S.C. § 119, the content of which in its entirety is herein incorporated by reference.

BACKGROUND

1. Field

Embodiments of the disclosure relate to a display device and a driving method of the display device.

2. Description of the Related Art

In general, an electronic device such as a smart phone, a digital camera, a notebook computer, a navigation device, a smart television, and the like that provides images to users includes a display device for displaying images. The display device generates an image and then provides a user with the generated image through a display screen.

The display device typically includes a plurality of pixels for generating an image, a scan driver for applying scan signals to the pixels, and a data driver for applying data voltages to the pixels. The pixels may receive the data voltages in response to the scan signals, and then may generate an image by using the data voltages.

The pixels are driven on a frame-by-frame basis, and each frame may include a display period, in which the image signals are provided, and a blank period following the display period. The frames may be provided to pixels at various frequencies.

SUMMARY

In a display device where pixels are driven at different frequencies or at a high frequency and a low frequency, a difference in luminance between pixels driven at the high frequency and pixels driven at the low frequency may be visually perceived.

Embodiments of the disclosure provide a display device capable of reducing a luminance difference between pixels when an operating frequency is changed from a high frequency to a low frequency, and a driving method of the display device.

According to an embodiment, a plurality of pixels connected to a plurality of first scan lines, a plurality of second scan lines, and a plurality of data lines, where the pixels are arranged in a plurality of rows, a plurality of first stages connected to the first scan lines, a plurality of second stages connected to the second scan lines, and a data driver connected to the data lines. In such an embodiment, each of the first scan lines is connected to pixels arranged in a corresponding row among the rows. In such an embodiment, each of the second scan lines is commonly connected to pixels arranged in corresponding 8h rows among the plurality of rows, where h is a natural number.

According to an embodiment, a driving method of a display device includes applying first scan signals and data voltages to pixels, and selectively applying second scan signals and black data voltages to the pixels. In such an embodiment, the pixels are driven during a plurality of frames, each of which has a display period and a blank period. In such an embodiment, the selectively applying the second scan signals and the black data voltages to the pixels includes measuring a blank period of an n-th frame, comparing a measurement period obtained by measuring the blank period with a reference period, and selectively applying the second scan signals and the black data voltages to the pixels during a (n+1)-th frame based on a result of the comparing.

BRIEF DESCRIPTION OF THE DRAWINGS

The above and other features of the disclosure will become apparent by describing in detail embodiments thereof with reference to the accompanying drawings, in which.

DETAILED DESCRIPTION

Figure 1:
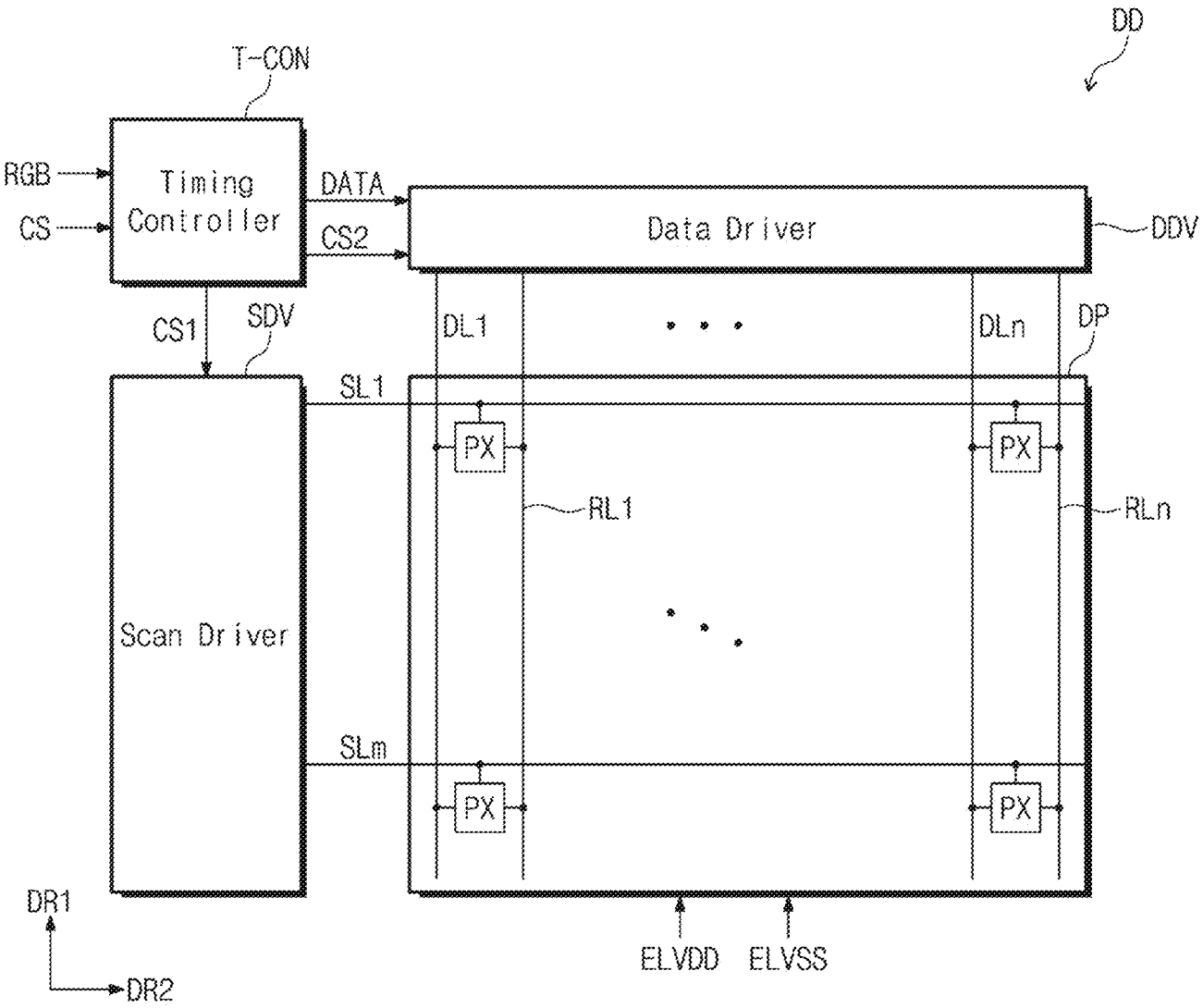
FIG. 1 is a block diagram of a display device, according to an embodiment of the disclosure.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art.

In the specification, when one component (or area, layer, part, or the like) is referred to as being "on", "connected to", or "coupled to" another component, it should be understood that the former may be directly on, connected to, or coupled to the latter, and also may be on, connected to, or coupled to the latter via a third intervening component.

Like reference numerals refer to like components. Also, in drawings, the thickness, ratio, and dimension of components are exaggerated for effectiveness of description of technical contents.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items.

The terms "first", "second", etc. are used to describe various components, but the components are not limited by the terms. The terms are used only to differentiate one component from another component. For example, a first component may be named as a second component, and vice versa, without departing from the spirit or scope of the disclosure.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The terms "below" or "beneath" can, therefore, encompass both an orientation of above and below.

Unless otherwise defined, all terms (including technical terms and scientific terms) used in this specification have the same meaning as commonly understood by those skilled in the art to which the disclosure belongs. Furthermore, terms such as terms defined in commonly used dictionaries should be interpreted as having a meaning consistent with the meaning in the context of the related technology, and is explicitly defined herein unless interpreted in ideal or overly formal meanings.

It will be understood that the terms "include", "comprise", "have", etc. specify the presence of features, numbers, steps, operations, elements, or components, described in the specification, or a combination thereof, not precluding the presence or additional possibility of one or more other features, numbers, steps, operations, elements, or components or a combination thereof.

Hereinafter, embodiments of the disclosure will be described in detail with reference to accompanying drawings.

FIG. 1 is a block diagram of a display device, according to an embodiment of the disclosure.

Referring to FIG. 1, an embodiment of a display device DD may include a display panel DP, a scan driver SDV, a data driver DDV, and a timing controller T-CON. The display panel DP may include a plurality of pixels PX, a plurality of scan lines SL1 to SLm, a plurality of data lines DL1 to DLn, and a plurality of reference lines RL1 to RLn. Here, each of 'm' and 'n' are a natural number.

In an embodiment of the disclosure, the display panel DP may be a light emitting display panel, but is not particularly limited thereto. In one embodiment, for example, the display panel DP may be an organic light emitting display panel or an inorganic light emitting display panel. A light emitting layer of the organic light emitting display panel may include an organic light emitting material. A light emitting layer of the inorganic light emitting display panel may include a quantum dot, a quantum rod, and the like. Hereinafter, for convenience of description, embodiments where the display panel DP is an organic light emitting display panel will be described in detail.

The data lines DL1 to DLn and the reference lines RL1 to RLn may extend in a first direction DR1 to be connected to the pixels PX and the data driver DDV. The scan lines SL1 to SLm may extend in a second direction DR2 intersecting the first direction DR1 to be connected to the pixels PX and the scan driver SDV.

A first voltage ELVDD and a second voltage ELVSS having a lower level than the first voltage ELVDD may be applied to the display panel DP. The first voltage ELVDD and the second voltage ELVSS may be applied to the pixels PX. Although not shown in FIG. 1, the display device DD may further include a voltage generator for generating the first voltage ELVDD and the second voltage ELVSS.

The timing controller T-CON may receive image signals RGB and a control signal CS from an outside or an external device (e.g., a system board). The timing controller T-CON may generate pieces of image data DATA by converting data formats of the image signals RGB to be suitable for an interface specification with the data driver DDV. The timing controller T-CON may provide the data driver DDV with the pieces of image data DATA, of which the data format is converted.

The timing controller T-CON may generate and output a scan control signal CS1 and a data control signal CS2 in response to the control signal CS provided from the outside.

The scan control signal CS1 may be provided to the scan driver SDV. The data control signal CS2 may be provided to the data driver DDV.

The scan driver SDV may generate a plurality of scan signals in response to the scan control signal CS1. The scan signals may be applied to the pixels PX through the scan lines SL1 to SLm.

The data driver DDV may generate a plurality of data voltages corresponding to the pieces of image data DATA in response to the data control signal CS2. The data voltages may be applied to the pixels PX through the data lines DL1 to DLn.

The pixels PX may receive the data voltages in response to scan signals. The pixels PX may display images by emitting light of luminance corresponding to data voltages The data driver DDV may further apply sensing data voltages to the pixels PX connected to the selected scan line. Sensing pixel currents generated from the pixels PX based on the sensing data voltages may be provided to the data driver DDV through the reference lines RL1 to RLn. Hereinafter, this operation will be described in detail.

The data driver DDV may sample the sensing pixel currents generated by the pixels PX. As a result, driving features of the pixels PX may be sensed.

The timing controller T-CON may update a compensation value for compensating for a change in the driving features of the pixels PX based on the sensing result. The driving may be defined as a sensing driving. The timing controller T-CON may correct the image signals RGB such that the deviation of the driving features of the pixels PX is compensated based on the sensing result according to real-time sensing, and then may transmit the corrected image signals RGB to the data driver DDV FIG. 2 is a diagram illustrating pixels and scan lines shown in FIG. 1 in more detail.

Figure 2:
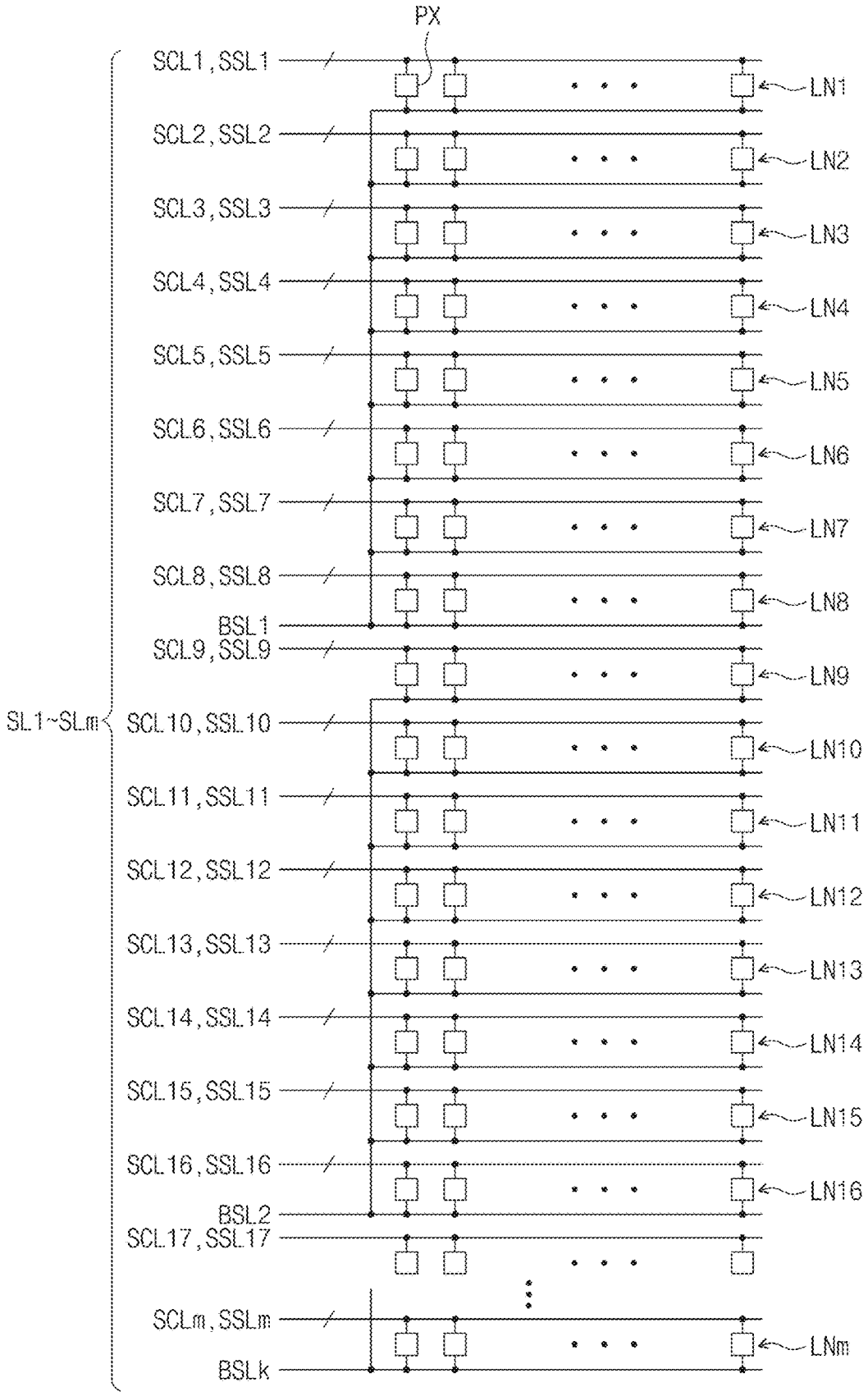
FIG. 2 is a diagram illustrating pixels and scan lines shown in FIG. 1 in more detail.

Referring to FIG. 2, in an embodiment, the pixels PX may be arranged in 'm' rows LN1 to LNm. The scan lines SL1 to SLm may include a plurality of first scan lines (SCL1 to SCLm, SSL1 to SSLm) and a plurality of second scan lines BSL1 to BSLk. Here, 'k' is a natural number less than 'm'. The first scan lines (SCL1 to SCLm, SSL1 to SSLm) may include a plurality of write scan lines SCL1 to SCLm and a plurality of sampling scan lines SSL1 to SSLm.

The pixels PX may be connected to the first scan lines (SCL1 to SCLm, SSL1 to SSLm) and the second scan lines BSL1 to BSLk. Each of the first scan lines (SCL1 to SCLm, SSL1 to SSLm) may be connected to the pixels PX arranged in a corresponding row among the 'm' rows LN1 to LNm. The first scan lines (SCL1 to SCLm, SSL1 to SSLm) may be sequentially arranged in the 'm' rows LN1 to LNm to be connected to the pixels PX.

Each of the write scan lines SCL1 to SCLm may be connected to the pixels PX arranged in a corresponding row among the 'm' rows LN1 to LNm. The write scan lines SCL1 to SCLm may be sequentially arranged in the 'm' rows LN1 to LNm to be connected to the pixels PX.

Each of the sampling scan lines SSL1 to SSLm may be connected to the pixels PX arranged in a corresponding row among the 'm' rows LN1 to LNm. The sampling scan lines SSL1 to SSLm may be sequentially arranged in the 'm' rows LN1 to LNm to be connected to the pixels PX.

The number of the second scan lines BSL1 to BSLk may be smaller than the number of the first scan lines (SCL1 to SCLm, SSL1 to SSLm). In one embodiment, for example, the number of second scan lines BSL1 to BSLk may be smaller than the number of the write scan lines SCL1 to SCLm. The number of the second scan lines BSL1 to BSLk may be smaller than the number of the sampling scan lines SSL1 to SSLm.

In an embodiment, as shown in FIG. 2, each of the second scan lines BSL1 to BSLk may be commonly connected to the pixels PX arranged in corresponding 8 rows among the 'm' rows LN1 to LNm. However, this is illustrated as one embodiment, and embodiments of the disclosure are not limited thereto. In an embodiment, each of the second scan lines BSL1 to BSLk may be commonly connected to the pixels PX arranged in corresponding '8h' (consecutive) rows among the 'm' rows LN1 to LNm. Here, 'h' is a natural number less than 'm'. In one embodiment, for example, each of the second scan lines BSL1 to BSLk may be commonly connected to the pixels PX arranged in corresponding 16 rows among the 'm' rows LN1 to LNm. In an alternative embodiment, under the condition of a multiple of 8, each of the second scan lines BSL1 to BSLk may be commonly connected to the pixels PX arranged in corresponding 24 rows, 32 rows, 40 rows, or 48 rows, among the 'm' rows LN1 to LNm.

The second scan lines BSL1 to BSLk may be commonly connected to the pixels PX in units of '8' rows sequentially in the 'm' rows LN1 to LNm. However, the disclosure is not limited thereto. The second scan lines BSL1 to BSLk may be commonly connected to the pixels PX sequentially in units of '16' rows among the 'm' rows LN1 to LNm. Hereinafter, for convenience of description, the structure of the second scan lines BSL1 to BSLk commonly connected to the pixels PX in units of 8 rows will be described.

The 1st second scan line BSL1 may be commonly connected to the pixels PXs arranged in the first to eighth rows LN1 to LN8. The 2nd second scan line BSL2 may be commonly connected to the pixels PXs arranged in the ninth to sixteenth rows LN9 to LN16. Other second scan lines may be connected to the other pixels PX in the same manner as described above.

Figure 3:
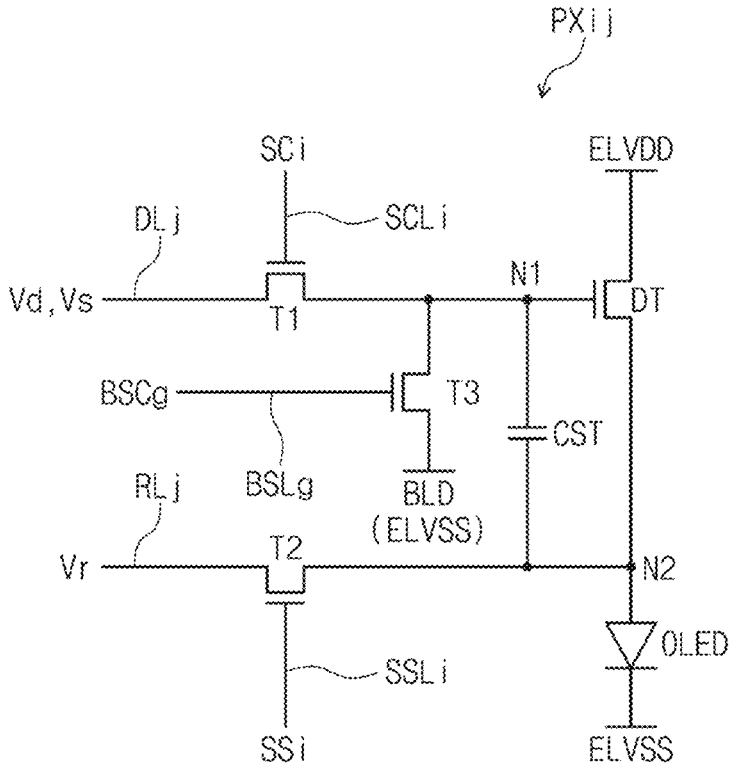
FIG. 3 is a diagram illustrating an equivalent circuit of one pixel shown in FIG. 1.

FIG. 3 is a diagram illustrating an equivalent circuit of one pixel shown in FIG. 1.

An embodiment of a pixel PXij connected to i-th first scan lines (SCLi, SSLi), a g-th second scan line BSLg, a j-th data line DLj, and a j-th reference line RLj is illustrated in FIG. 3. Each of 'i', 'j', and 'g' is a natural number.

Referring to FIG. 3, an embodiment of the pixel PXij may be connected to the i-th first scan lines (SCLi, SSLi), the g-th second scan line BSLg, the j-th data line DLj, and the j-th reference line RLj.

The i-th first scan lines (SCLi, SSLi) may receive i-th first scan signals (SCi, SSi). The i-th first scan signals (SCi, SSi) may include the i-th write scan signal SCi and the i-th sampling scan signal SSi.

The i-th first scan lines (SCLi, SSLi) may include the i-th write scan line SCLi and the i-th sampling scan line SSLi. The i-th write scan line SCLi may receive the i-th write scan signal SCi. The i-th sampling scan line SSLi may receive the i-th sampling scan signal SSi. The g-th second scan line BSLg may receive a g-th second scan signal BSCg.

The pixel PXij may include a light emitting element OLED, a plurality of transistors (DT, T1 to T3), and a capacitor CST. The transistors (DT, T1 to T3) may include a driving transistor DT, a first switch transistor T1, a second switch transistor T2, and a third switch transistor T3.

The transistors (DT, T1 to T3) may be N-type transistors, e.g., N-type metal-oxide-semiconductor ("NMOS") transistors, but not limited thereto. In one embodiment, for example, the transistors (DT, T1 to T3) may be P-type transistors, e.g., P-type metal-oxide-semiconductor ("PMOS") transistors. Each of the transistors (DT, T1 to T3) may include a source electrode, a drain electrode, and a gate electrode. Hereinafter, for convenience of description, one of the source electrode and the drain electrode is defined as the first electrode, and the other of the source electrode and the drain electrode is defined as the second electrode. Also, the gate electrode is defined as a control electrode.

Hereinafter, the driving transistor DT, the first switch transistor T1, the second switch transistor T2, and the third switch transistor T3 are defined as the driving element DT, the first switch element T1, the second switch element T2, and the third switch element T3, respectively.

The light emitting element OLED may be an organic light emitting element including an anode and a cathode. The anode of the light emitting element OLED may receive the first voltage ELVDD through the driving element DT. The cathode of the light emitting element OLED may receive the second voltage ELVSS. The light emitting element OLED may receive the first voltage ELVDD and the second voltage ELVSS to emit light.

The driving element DT may include a first electrode that receives the first voltage ELVDD, a second electrode connected to the anode of the light emitting element OLED, and a control electrode connected to a first node N1.

The capacitor CST may be connected to the control electrode of the driving element DT and the anode of the light emitting element OLED. The capacitor CST may include a first electrode connected to the control electrode of the driving element DT and a second electrode connected to the anode of the light emitting element OLED. A contact where the anode of the light emitting element OLED is connected to the second electrode of the capacitor CST may be defined as a second node N2.

The first switch element T1 may include a first electrode connected to the j-th data line DLj, a second electrode connected to the first node N1, and a control electrode that receives the i-th write scan signal SCi. The j-th data line DLj may receive a data voltage Vd and a sensing data voltage Vs.

The second switch element T2 may include a first electrode connected to the j-th reference line RLj, a second electrode connected to the anode of the light emitting element OLED, and a control electrode that receives the i-th sampling scan signal SSi. The j-th reference line RLj may receive a reference voltage Vr.

The third switch element T3 may include a first electrode connected to the first node N1, a second electrode that receives a black data voltage BLD, and a control electrode that receives the g-th second scan signal BSCg. The black data voltage BLD applied to the second electrode of the third switch element T3 may have a same level as the second voltage ELVSS.

Hereinafter, the operation of the pixel PXij will be described in detail with reference to FIGS. 5, 6, and 7.

Figure 4:
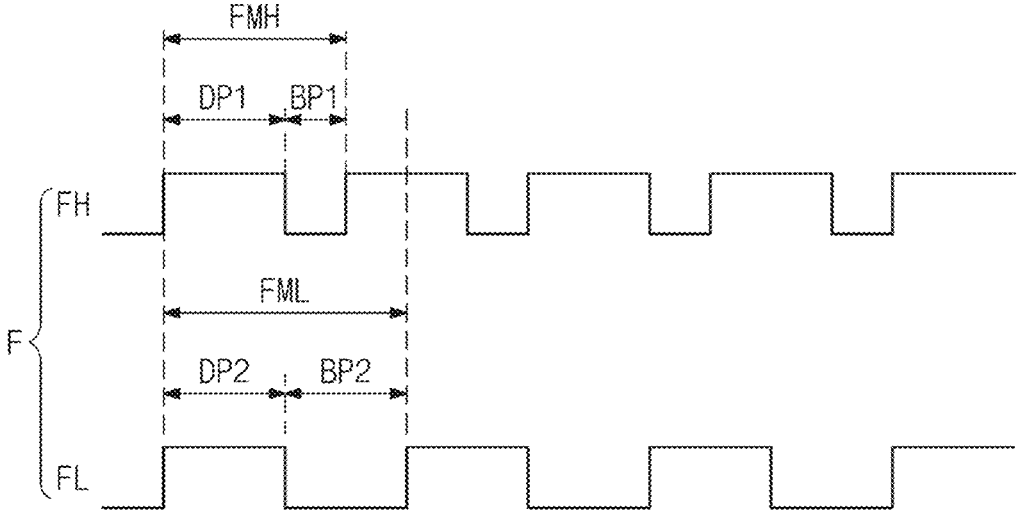
FIG. 4 is a signal timing diagram of frames for operations of pixels shown in FIG. 1.

FIG. 4 is a signal timing diagram of frames for operations of pixels shown in FIG. 1.

Referring to FIGS. 1 and 4, the pixels PX may be driven in a plurality of frames FMH and FML. Each of the frames FMH and FML may include a display period DP1 or DP2 and a blank period BP1 or BP2.

The frames FMH and FML may have various frequencies F, that is, include frames having different frequencies F from each other. The frames FMH and FML may include the first frame FMH having a first frequency FH and the second frame FML having a second frequency FL. The second frequency FL may be lower than the first frequency FH. The pixels PX may be driven at the first frequency FH and the second frequency FL.

The first frame FMH may include a first display period DP1 and a first blank period BP1 following the first display period DP1. The second frame FML may include a second display period DP2 and a second blank period BP2 following the second display period DP2.

The first display period DP1 may be the same as the second display period DP2. The second blank period BP2 may be longer than the first blank period BP1. In an embodiment of the disclosure, a reference period may be used to check an operating frequency. The reference period may be set to be the same as the first blank period BP1. Hereinafter, the use of the reference period will be described in detail.

The first frequency FH may be defined as a normal frequency. The second frequency FL may be defined as an abnormal frequency. In general, the pixels PX may be driven at the first frequency FH. However, the frequency may be changed due to noise or the like, and thus the pixels PX may be driven at the second frequency FL. In this case, a flicker phenomenon that a difference in luminance between the pixels PX driven at the first frequency FH and the pixels PX driven at the second frequency FL is visually perceived may occur.

In an embodiment of the disclosure, the difference in luminance between the pixels PX driven at the first frequency FH and the pixels PX driven at the second frequency FL may be reduced. Hereinafter, this operation will be described in detail.

Figure 5:
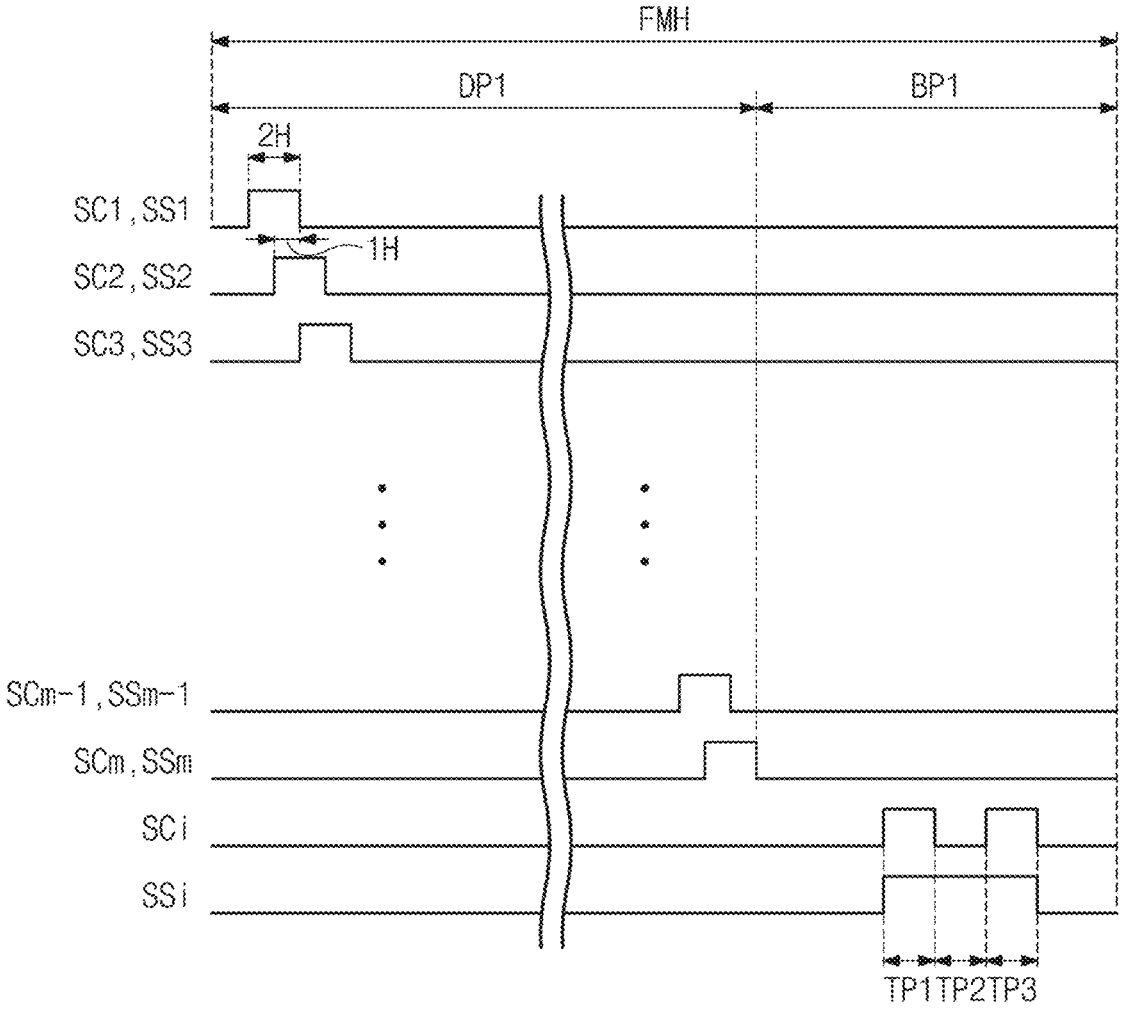
FIG. 5 is a signal timing diagram of first scan signals applied to first scan lines shown in FIG. 2.

FIG. 5 is a signal timing diagram of first scan signals applied to first scan lines shown in FIG. 2.

In FIG. 5, the first scan signals (SC1 to SCm, SS1 to SSm) are shown in the first frame FMH having the first frequency FH. However, even in the second frame FML having the second frequency FL, the first scan signals (SC1 to SCm, SS1 to SSm) may have the timing shown in FIG. 5.

Referring to FIGS. 2 and 5, the first scan signals (SC1 to SCm, SS1 to SSm) may be sequentially output during the first display period DP1. The first scan signals (SC1 to SCm, SS1 to SSm) may be provided to the pixels PX through the first scan lines (SCL1 to SCLm, SSL1 to SSLm).

During the first display period DP1, the write scan signals SC1 to SCm may be output sequentially. During the first display period DP1, the sampling scan signals SS1 to SSm may be sequentially output. During the first display period DP1, the write scan signals SC1 to SCm and the sampling scan signals SS1 to SSm may have a same timing as each other.

Herein, an activation period is defined as a high level, and a deactivation period is defined as a low level lower than the high level.

During the first display period DP1, the activation period of each of the first scan signals (SC1 to SCm, SS1 to SSm) may have 2H period. During the first display period DP1, the first scan signals (SC1 to SCm, SS1 to SSm) may overlap one another by 1H period. In one embodiment, for example, the (i+1)-th write scan signal (SCi+1) may overlap the i-th write scan signal SCi by 1H period. The (i+1)-th sampling scan signal (SSi+1) may overlap the i-th sampling scan signal SSi by 1H period.

During the first blank period BP1, the pixels PX arranged in one row may be selected, and one write scan signal and one sampling scan signal may be applied to the selected pixels. In an embodiment, the i-th write scan signal SCi may be applied to the pixels PX connected to the i-th write scan line SCLi through the i-th write scan line SCLi. The i-th sampling scan signal SSi may be applied to the pixels PX connected to the i-th sampling scan line SSLi through the i-th sampling scan line SSLi.

The first blank period BP1 may include a first period TP1, a second period TP2, and a third period TP3 that are continuously arranged. The i-th write scan signal SCi may be activated during the first period TP1 and the third period TP3, and may be deactivated during the second period TP2. The i-th sampling scan signal SSi may be activated during the first period TP1, the second period TP2, and the third period TP3.

Figure 6:
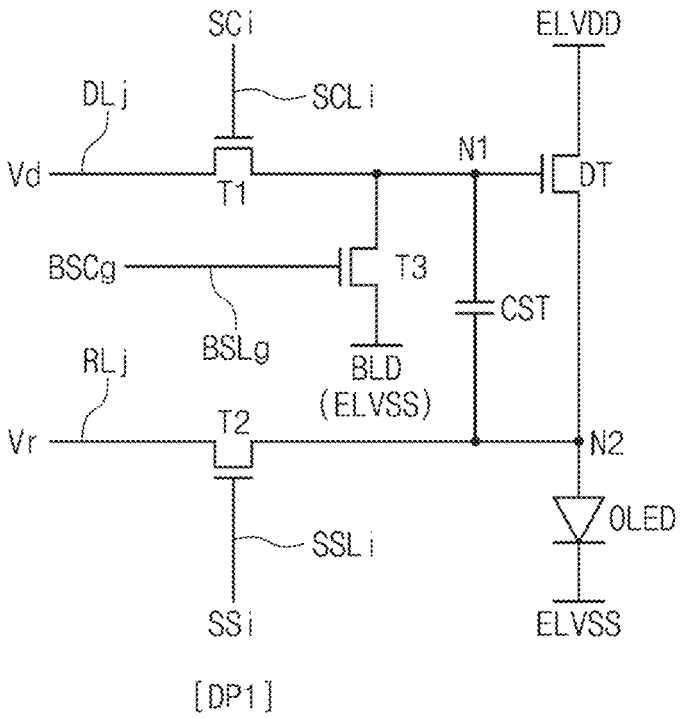
FIG. 6 is a diagram for describing an operation of a pixel during a first display period shown in FIG. 5.
Figure 7A:
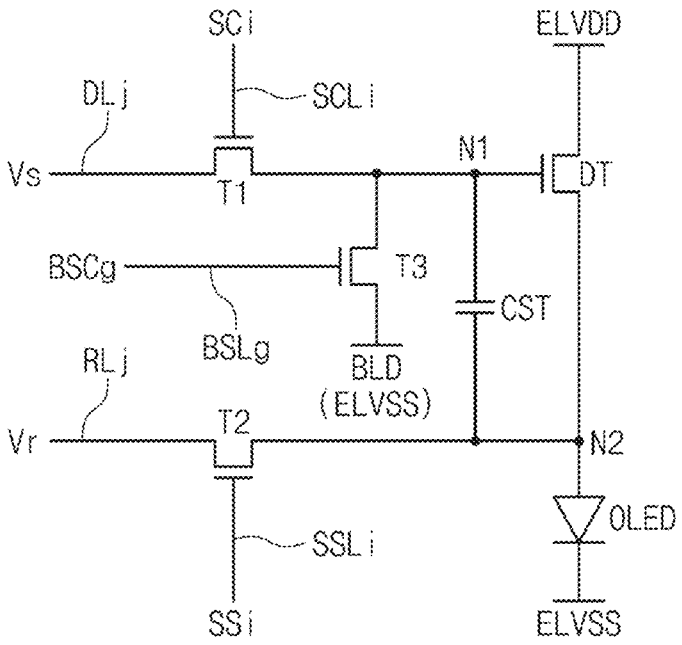
FIGS. 7A to 7C are diagrams for describing an operation of a pixel selected during first, second, and third periods illustrated in FIG. 5.
Figure 7B:
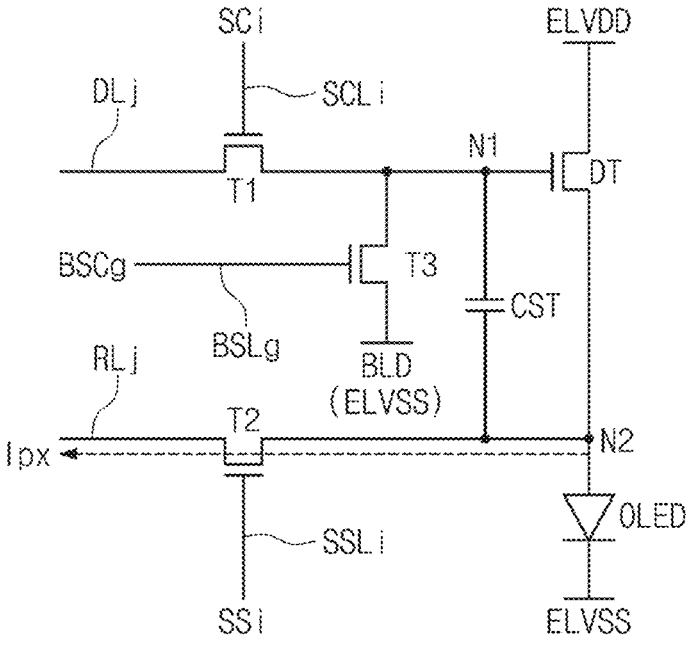
Figure 7C:
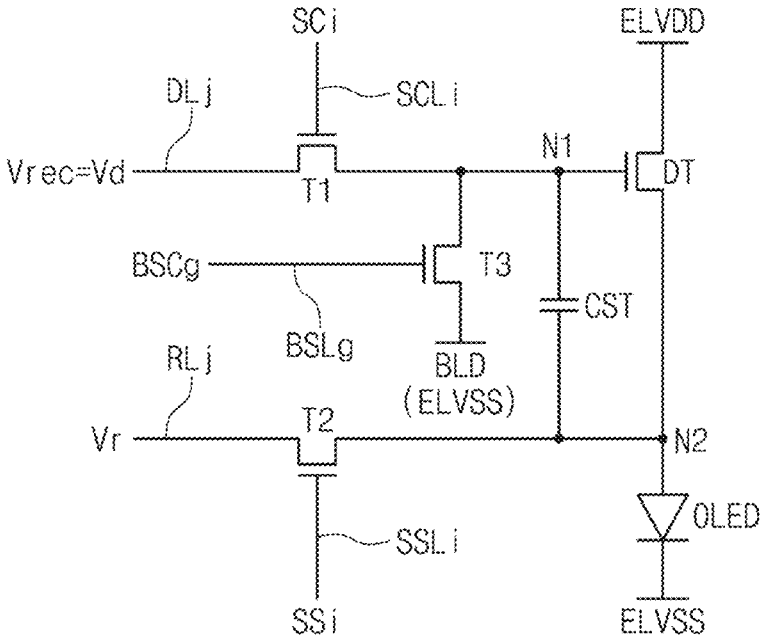

FIG. 6 is a diagram for describing an operation of a pixel during a first display period shown in FIG. 5. FIGS. 7A to 7C are diagrams for describing an operation of a pixel selected during first, second, and third periods illustrated in FIG. 5.

An embodiment of the pixel PXij shown in FIG. 3 is illustrated in FIGS. 6 and 7A to 7C. An operation of the single pixel PXij will be described. However, the other pixels PX not shown may operate in the same manner as the pixel PXij shown in FIG. 6.

Referring to FIGS. 5 and 6, during a program period of the first display period DP1, the activated i-th write scan signal SCi and the activated i-th sampling scan signal SSi may be applied to the pixel PXij. The first switch element T1 may be turned on in response to the i-th write scan signal SCi. The second switch element T2 may be turned on in response to the i-th sampling scan signal SSi.

The data voltage Vd may be applied to the control electrode of the driving element DT through the j-th data line DLj. The reference voltage Vr may be applied to the second electrode of the driving element DT through the j-th reference line RLj.

A voltage between the first node N1 and the second node N2 may be set as a difference between the data voltage Vd and the reference voltage Vr. A charge corresponding to the difference between the data voltage Vd and the reference voltage Vr may be charged in the capacitor CST. Accordingly, during the program period, the voltage between the first node N1 (or a gate node) and the second node N2 (or a source node) may be set to match a desired pixel current. The voltage between the first node N1 and the second node N2 may be defined as a gate-source voltage.

During a light emitting period after the program period, the i-th write scan signal SCi and the i-th sampling scan signal SSi are deactivated, and thus the first and second switch elements T1 and T2 may be turned off. The voltage between the first node N1 and the second node N2 may be maintained by the capacitor CST.

Because the voltage between the first node N1 and the second node N2 is greater than a threshold voltage of the driving element DT, a pixel current may flow into the driving element DT during the light emitting period. During the light emitting period, the potential of the first node N1 and the potential of the second node N2 may be boosted by the pixel current while maintaining the voltage between the first node N1 and the second node N2. When the potential of the second node N2 is boosted to the operating point level of the light emitting element OLED, the light emitting element OLED may emit light.

The first scan signals (SC1 to SCm, SS1 to SSm) are sequentially applied to the pixels PX, and thus the pixels PX may operate in a same manner as the pixel PXij described above.

Referring to FIGS. 5 and 7A, during the first period TP1, the activated i-th write scan signal SCi and the activated i-th sampling scan signal SSi may be applied to the selected pixel PXij. The first switch element T1 and the second switch element T2 may be turned on by the i-th write scan signal SCi and the i-th sampling scan signal SSi.

The sensing data voltage Vs may be applied to the control electrode of the driving element DT through the j-th data line DLj. The reference voltage Vr may be provided to the second electrode of the driving element DT through the j-th reference line RLj. Accordingly, the voltage between the first node N1 (or a gate node) and the second node N2 (or a source node) may be set to match a desired sensing pixel current.

Referring to FIGS. 5 and 7B, during the second period TP2, the i-th write scan signal SCi may be deactivated, and the i-th sampling scan signal SSi may remain in an activated state. The first switch element T1 may be turned off, and the second switch element T2 may remain in an on-state.

A sensing pixel current Ipx flowing through the driving element DT may be provided to the data driver DDV through the second switch element T2 and the j-th reference line RLj. The data driver DDV may sample the sensing pixel current Ipx generated by the pixel PXij. As a result, driving features of the pixels PX may be sensed.

Referring to FIGS. 5 and 7C, during the third period TP3, the i-th write scan signal SCi may be activated, and the i-th sampling scan signal SSi may remain in an activated state. The first switch element T1 may be turned on, and the second switch element T2 may maintain an on-state.

A restoration data voltage Vrec may be applied to the control electrode of the driving element DT. The reference voltage Vr may be applied to the second electrode of the driving element DT. The restoration data voltage Vrec may be substantially the data voltage Vd. Accordingly, during the third period TP3, the voltage between the first node N1 and the second node N2 may be restored to the original state of the first display period DP1.

At the first frequency FH, the data voltage Vd may be applied to the pixel PXij during the first display period DP1, and thus the data voltage Vd that is the restoration data voltage Vrec may be applied to the pixel PXij.

Operations of the pixels PX during the first display period DP1 and the first blank period BP1 are described above. However, the data voltage Vd and the sensing data voltage Vs may be also applied to the pixels PX during the second display period DP2 and the second blank period BP2.

Figure 8:
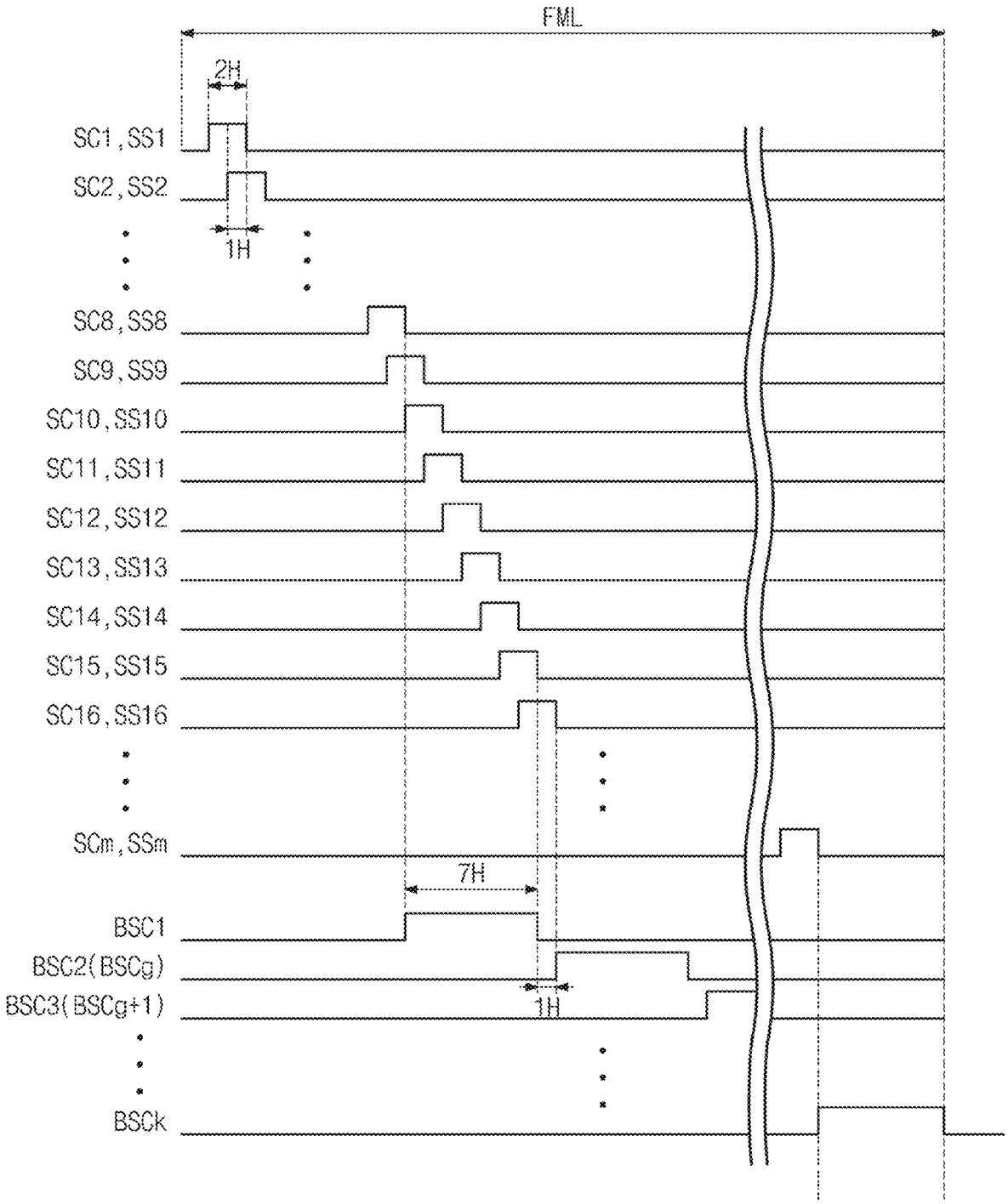
FIG. 8 is a signal timing diagram of second scan signals applied to second scan lines shown in FIG. 2.
Figure 9:
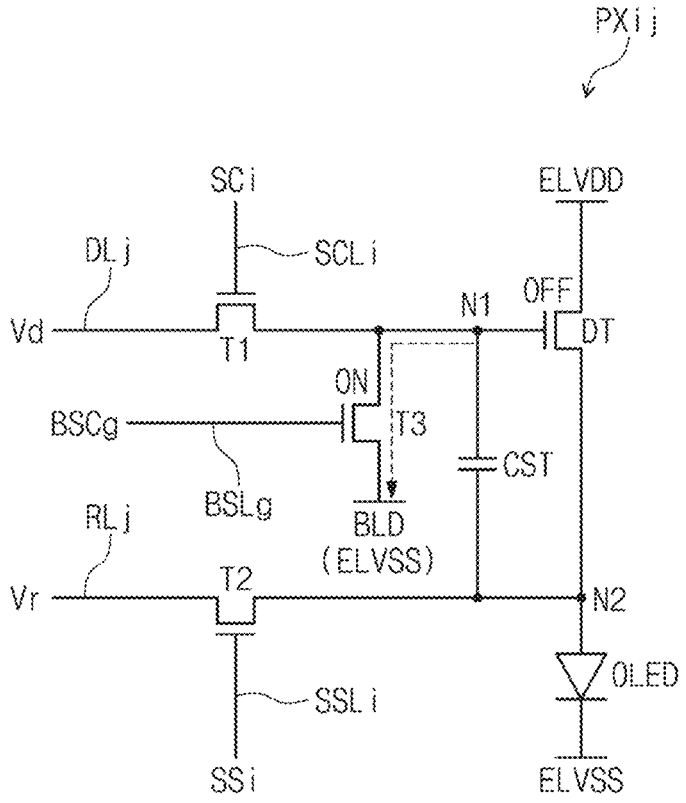
FIG. 9 is a diagram for describing an operation of a pixel according to one of second scan signals shown in FIG. 8.

FIG. 8 is a signal timing diagram of second scan signals applied to second scan lines shown in FIG. 2. FIG. 9 is a diagram for describing an operation of a pixel according to one of second scan signals shown in FIG. 8.

An embodiment of the pixel PXij shown in FIG. 3 is illustrated in FIG. 9. An operation of the single pixel PXij will be described. However, the other pixels PX may operate in the same manner as the pixel PXij shown in FIG. 9.

Referring to FIG. 8, the plurality of second scan signals BSC1 to BSCk may be sequentially output in the second frame FML having the second frequency FL. The second scan signals BSC1 to BSCk may be provided to the pixels PX through the second scan lines BSL1 to BSLk.

An activation period of each of the second scan signals BSC1 to BSCk may be 7H period. The second scan signals BSC1 to BSCk may not overlap each other and may be apart from each other by 1H period. In one embodiment, for example, the (g+1)-th second scan signal (BSCg+1) may be apart from the g-th second scan signal BSCg by 1H period.

During the second frame FML, the 1st second scan signal BSC1 among the second scan signals BSC1 to BSCk may be output in synchronization with the falling edge of the 8h-th first scan signals (SC8*h*, SS8*h*) applied to the pixels PX in the 8h-th rows. In one embodiment, for example, the 1st second scan signal BSC1 may be output in synchronization with the falling edge of the eighth write scan signal SC8 applied to the pixels PX in the eighth rows or the falling edge of the eighth sampling scan signal SS8 applied to the pixels PX in the eighth rows. In such an embodiment, the 2nd second scan signal BSC2 may be output in synchronization with the falling edge of the sixteenth write scan signal SC16 applied to the pixels PX in the sixteenth rows or the falling edge of the sixteenth sampling scan signal SS16 applied to the pixels PX in the sixteenth rows.

Referring to FIG. 9, the g-th second scan signal BSCg may be applied to the control electrode of the third switch element T3 through the g-th second scan line BSLg. The third switch element T3 may be turned on in response to the g-th second scan signal BSCg.

The black data voltage BLD may be applied to the control electrode of the driving element DT through the turned-on third switch element T3. Because the black data voltage BLD may be the second voltage ELVSS, the first node N1 may be discharged. Accordingly, the potential of the first node N1 may be lowered. Thus, the driving element DT may be turned off, and the light emitting element OLED may not emit light.

The black data voltage BLD may be set to the second voltage ELVSS, but not limited thereto. In one embodiment, for example, the black data voltage BLD may be set to one of other various voltages capable of turning off the driving element DT.

Figure 10:
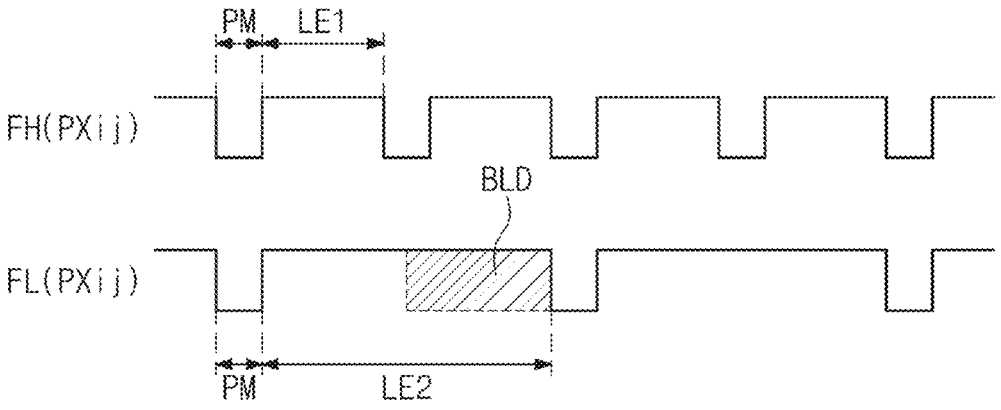
FIG. 10 is a diagram illustrating light emitting periods of a pixel driven at a first frequency and a pixel driven at a second frequency illustrated in FIG. 4.
Figure 11A:
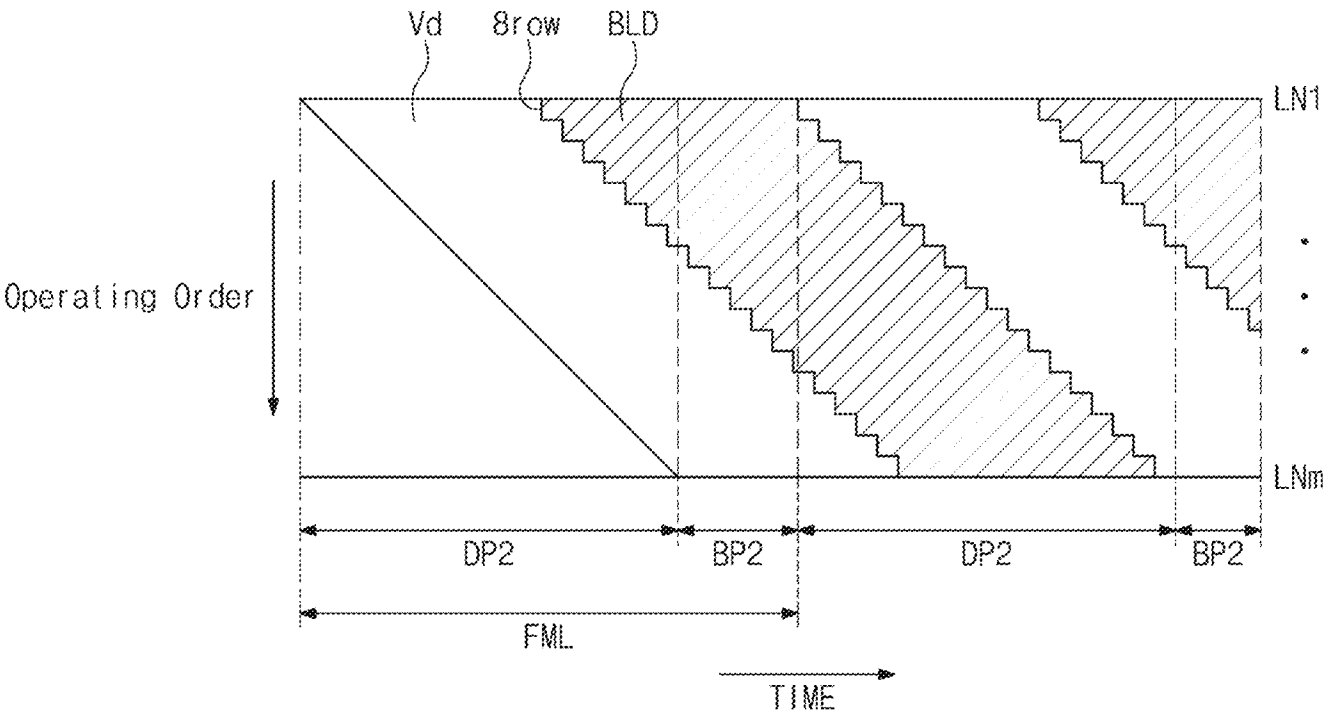
FIG. 11A is a diagram for describing light emission and light non-emission of pixels driven at a second frequency.
Figure 11B:
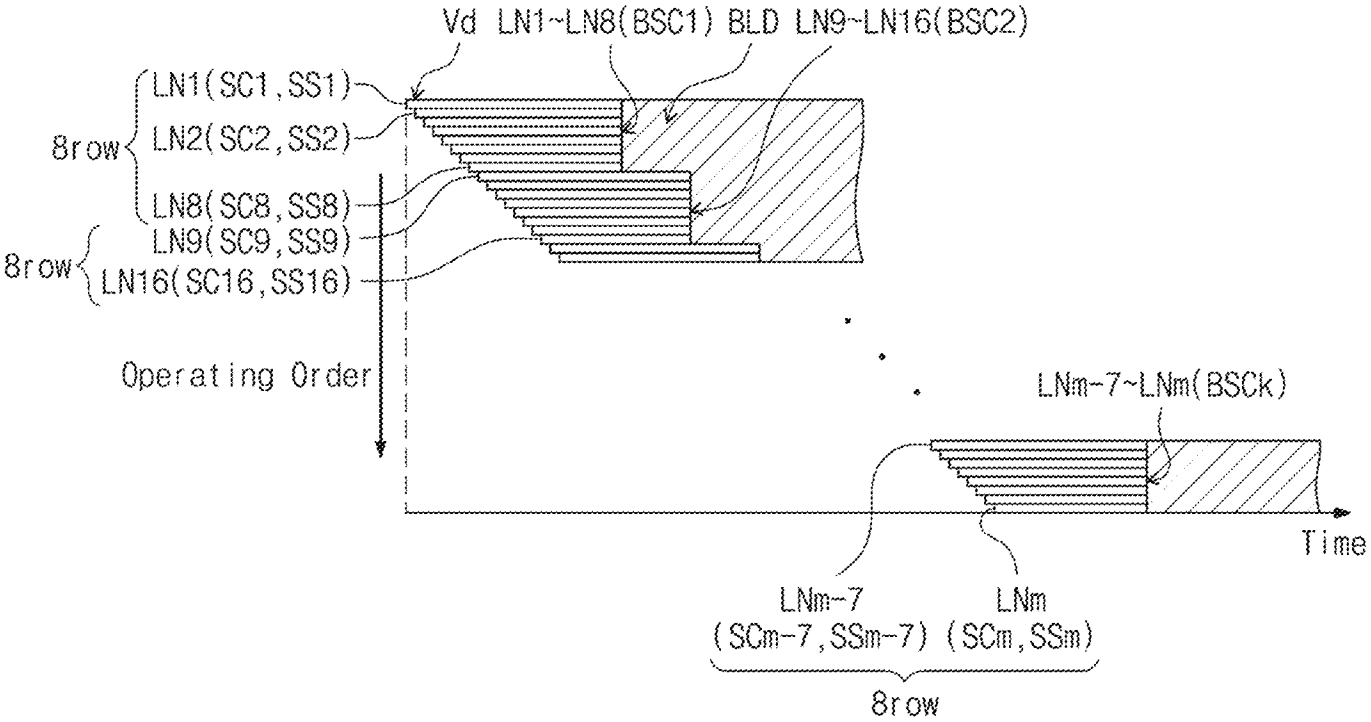
FIG. 11B is an enlarged view illustrating rows of pixels driven depending on first scan signals and rows of pixels driven depending on second scan signals in FIG. 11A.

FIG. 10 is a diagram illustrating light emitting periods of a pixel driven at a first frequency and a pixel driven at a second frequency illustrated in FIG. 4. FIG. 11A is a diagram for describing light emission and light non-emission of pixels driven at a second frequency. FIG. 11B is an enlarged diagram illustrating rows of pixels driven depending on first scan signals and rows of pixels driven depending on second scan signals in FIG. 11A.

FIG. 10 is a diagram illustrating a light emitting period of the pixel PXij. Hereinafter, an operation of the pixel PXij of FIGS. 6, 8, and 9 may be described together with FIGS. 10, 11A, and 11B.

Referring to FIGS. 6 and 10, during the program period PM, the pixel PXij driven at the first frequency FH may receive the data voltage Vd and may emit light during a first light emitting period LE1. When the pixel PXij driven at the second frequency FL does not receive the black data voltage BLD, the pixel PXij may receive a data voltage Vd during the program period PM and may emit light during a second light emitting period LE2.

The light emitting period may be longer at the second frequency FL, which is a low frequency, than the first frequency FH that is a high frequency. Accordingly, the second light emitting period LE2 may be longer than the first light emitting period LE1.

At the second frequency FL, the pixel PXij may emit light longer. Accordingly, when the first frequency FH is converted to the second frequency FL, a difference in luminance between the pixel PXij driven in the first frame FMH and the pixel PXij driven in the second frame FML may increase as described with reference to FIG. 4

Referring to FIGS. 9 and 10, in an embodiment, the black data voltage BLD may be applied to the pixel PXij at the second frequency FL. Accordingly, the light emission time of the pixel PXij is reduced at the second frequency FL, and thus the difference in luminance between the pixel PXij driven in the first frame FMH and the pixel PXij driven in the second frame FML may be reduced. As a result, when the first frequency FH is converted to the second frequency FL, the flicker phenomenon may be effectively prevented, thereby improving display quality.

Referring to FIGS. 8, 10, 11A, and 11B, the pixels PX arranged in the plurality of rows LN1 to LNm may be driven by receiving the data voltages Vd, in units of rows and sequentially. In one embodiment, for example, the first scan signals (SC1, SS1 to SC8, SS8) may be sequentially applied to first eight rows (brow) that are the first to eighth rows LN1 to LN8. The data voltages Vd may be applied to the first to eighth rows LN1 to LN8, in units of rows and sequentially, and thus the pixels PX may emit light, in units of rows and sequentially.

When the pixels PX are emitted sequentially in the first to eighth rows LN1 to LN8, the 1st second scan signal BSC1 may be commonly applied to the first to eighth rows LN1 to LN8. Accordingly, the black data voltage BLD may be applied to the pixels PX arranged in the first to eighth rows LN1 to LN8. As a result, the light emission of the pixels PX arranged in the first to eighth rows LN1 to LN8 may be stopped and thus light may not be emitted.

The first scan signals (SC8, SS8 to SC16, SS16) may be sequentially applied to the ninth to sixteenth rows LN9 to LN16 that are second eight rows (brow). The data voltages Vd may be applied to the ninth to sixteenth rows LN9 to LN16, in units of rows and sequentially, and thus the pixels PX may emit light, in units of rows and sequentially.

When the pixels PX are sequentially emitted in the ninth to sixteenth rows LN9 to LN16, the 2nd second scan signal BSC2 having timing following the timing of the 1st second scan signal BSC1 may be commonly applied to the ninth to sixteenth rows LN9 to LN16. Accordingly, the black data voltage BLD may be applied to the pixels PX arranged in the ninth to sixteenth rows LN9 to LN16. As a result, the light emission of the pixels PX arranged in the ninth to sixteenth rows LN9 to LN16 may be stopped and thus light may not be emitted. This operation may be repeatedly performed up to the m-th row LNm that is the last row.

Accordingly, in an embodiment, the pixels PX may receive the data voltages Vd to emit light, in units of rows and sequentially. In such an embodiment, when the pixels PX emit light, the black data voltage BLD may be sequentially applied to the pixels PX in units of 8 rows. As a result, the light emission time of the pixels PX driven at the second frequency FL may be reduced.

As described above with reference to FIG. 7C, at the first frequency FH, the data voltage Vd may be applied to the pixels PX outputting the sensing pixel current Ipx, during the third period TP3. However, at the second frequency FL, after the data voltage Vd is applied to the pixel PXij during the second display period DP2, the black data voltage BLD may be applied to the pixel PXij. Accordingly, at the second frequency FL, the black data voltage BLD, that is, the restoration data voltage Vrec, may be applied to the pixels PX, which output the sensing pixel current Ipx, during the third period TP3.

Figure 12:
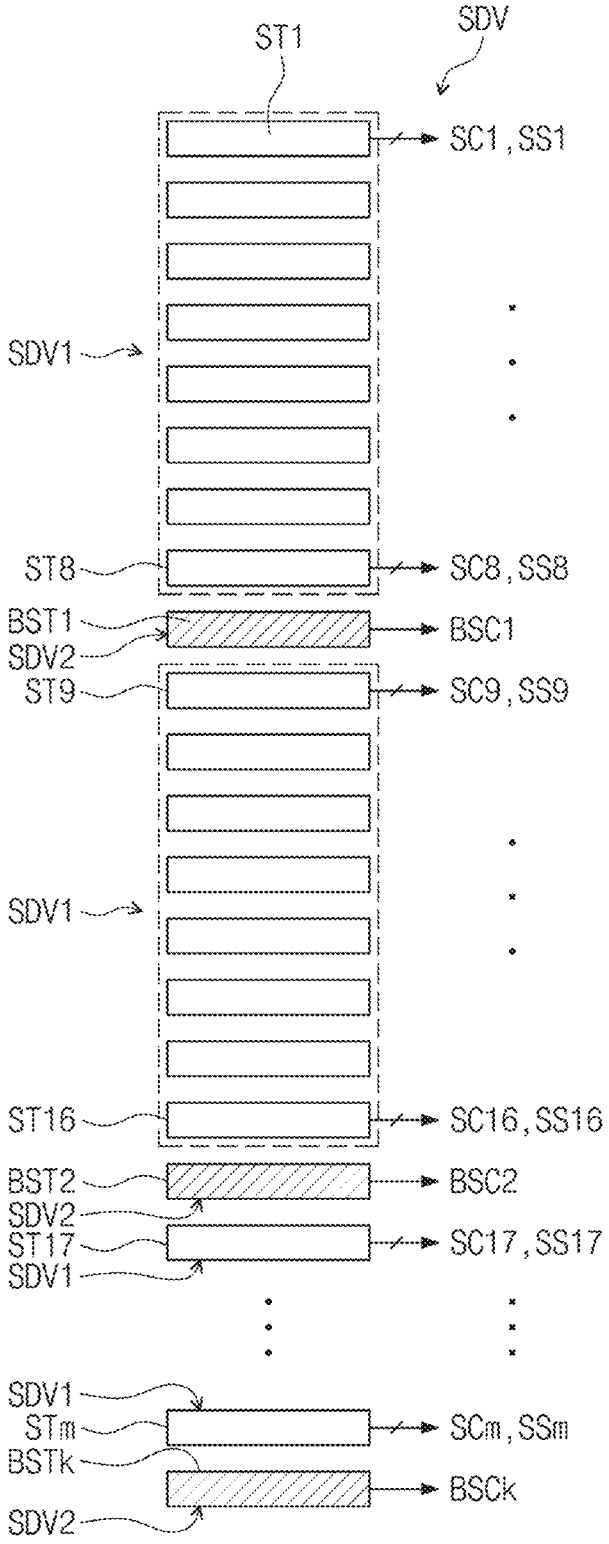
FIG. 12 is a diagram illustrating a configuration of a scan driver shown in FIG. 1.

FIG. 12 is a diagram illustrating a configuration of a scan driver shown in FIG. 1.

Referring to FIG. 12, an embodiment of the scan driver SDV may include a first scan driver SDV1 and a second scan driver SDV2. The first scan driver SDV1 may output first scan signals SC1 to SCm and SS1 to SSm. The second scan driver SDV2 may output second scan signals BSC1 to BSCk.

The first scan driver SDV1 may include a plurality of first stages ST1 to STm for generating and outputting the first scan signals SC1 to SCm and SS1 to SSm. The second scan driver SDV2 may include a plurality of second stages BST1 to BSTk for generating and outputting the second scan signals BSC1 to BSCk.

The number of the second stages BST1 to BSTk may be smaller than the number of the first stages ST1 to STm. The second stages BST1 to BSTk may be arranged adjacent to the first stages ST1 to STm. In an embodiment, one of the second stages BST1 to BSTk may be arranged for respective 8h first stages, where 'h' is a natural number. In an embodiment, as shown in FIG. 12, one of the second stages BST1 to BSTk may be arranged for respective 8 first stages, but not limited thereto. In one embodiment, for example, one of the second stages BST1 to BSTk may be arranged for respective 16 first stages. In an alternative embodiment, under the condition of a multiple of 8, one of the second stages BST1 to BSTk may be arranged for respective 24, 32, 40, or 48 first stages.

In one embodiment, for example, as shown in FIG. 12, the 1st second stage BST1 may be arranged after the 8th first stage ST8. The 9th first stage ST9 may be arranged after the 1st second stage BST1. The 2nd second stage BST2 may be arranged after the sixteenth first stage ST16. The 17th first stage ST17 may be arranged after the 2nd second stage BST2. Afterward, each of the second stages may be arranged adjacent to the other first stages in the same manner.

Figure 13:
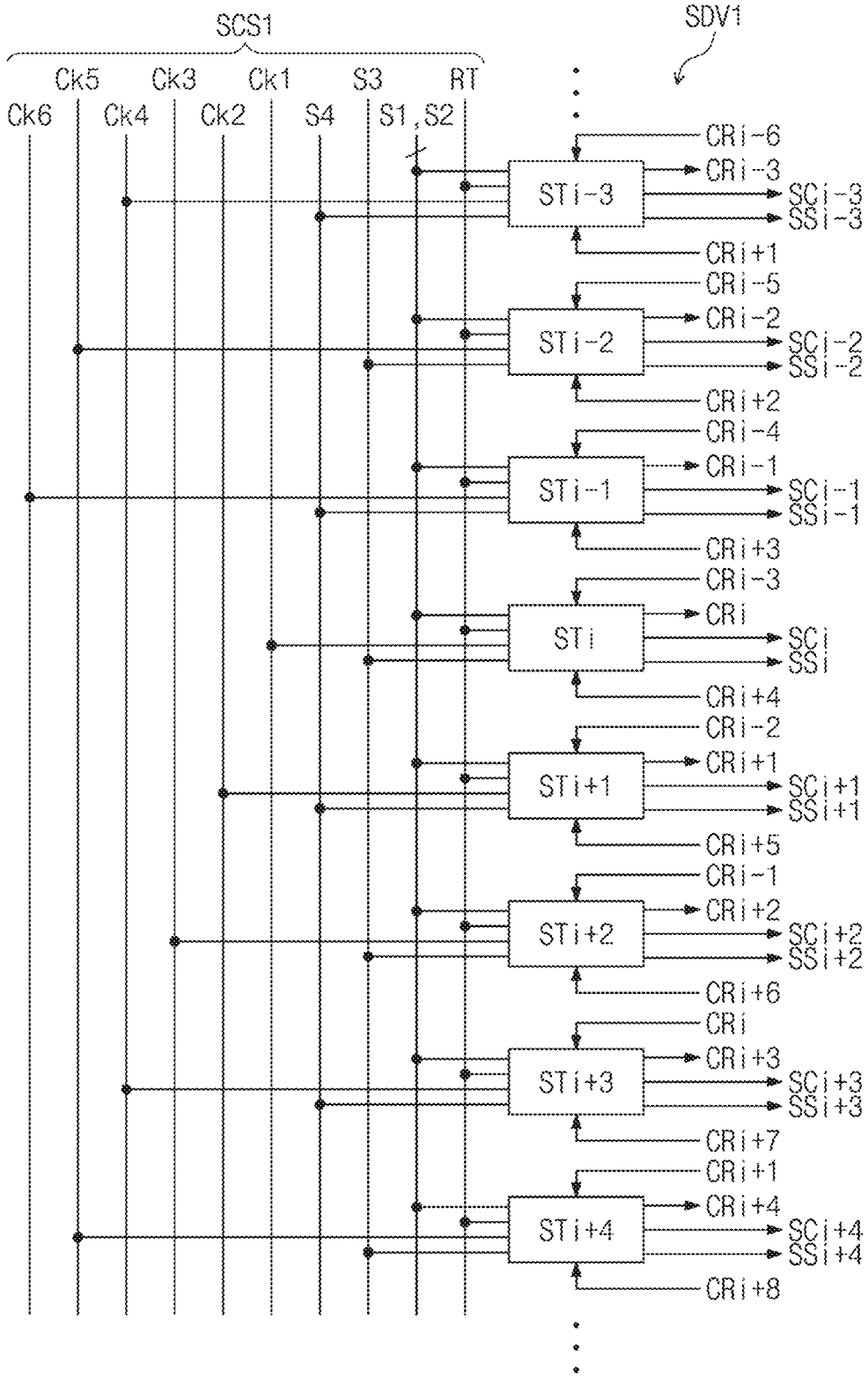
FIG. 13 is a diagram illustrating a connection relationship between first stages of a first scan driver shown in FIG. 12.
Figure 14:
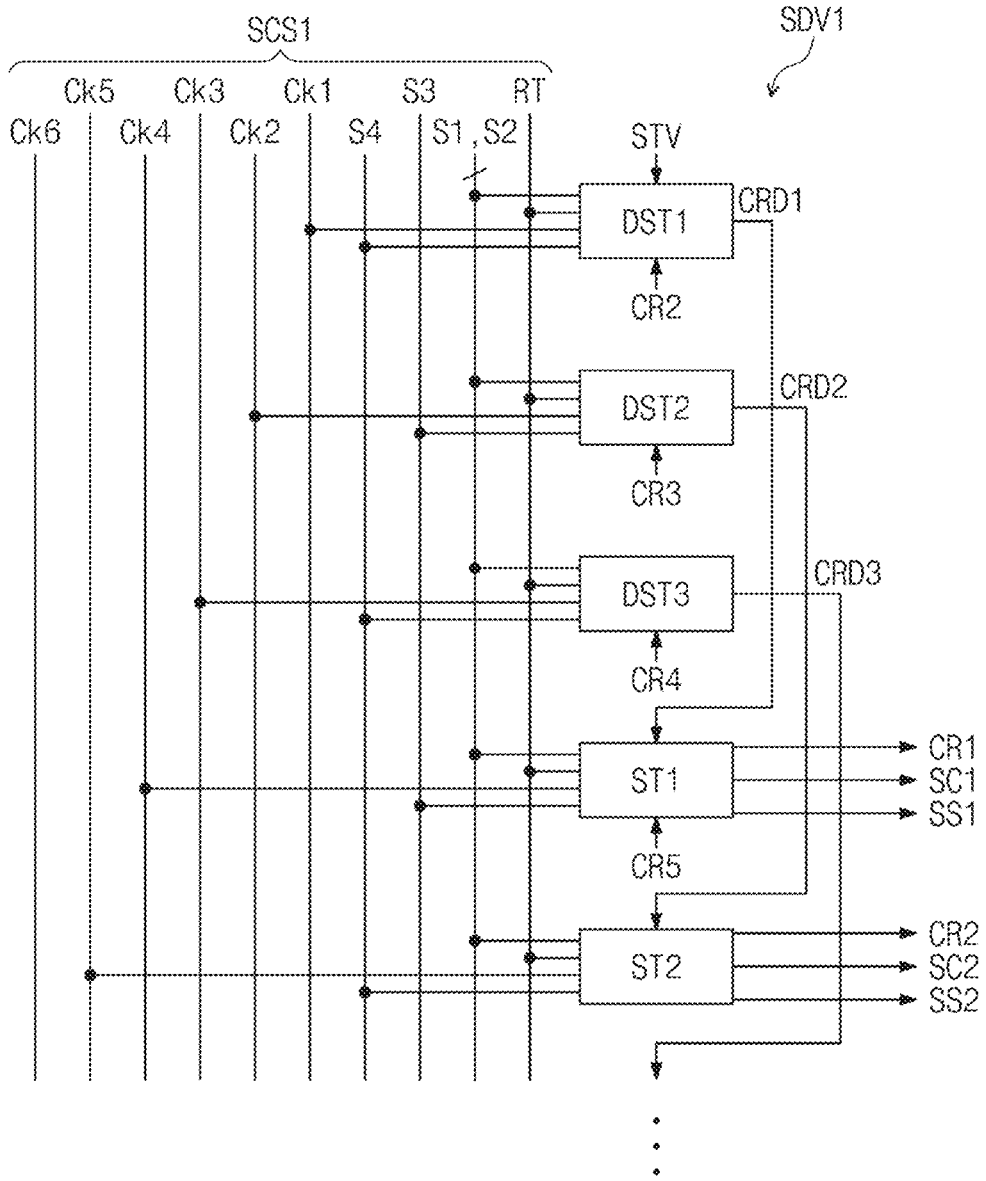
FIG. 14 is a diagram illustrating dummy stages arranged before a 1st first stage.

FIG. 13 is a diagram illustrating a connection relationship between first stages of a first scan driver shown in FIG. 12. FIG. 14 is a diagram illustrating dummy stages arranged before a 1st first stage.

FIG. 13 illustrates only eight first stages (STi−3 to STi+4) for convenience of illustration and description. FIG. 14 illustrates three dummy stages DST1 to DST3 and two first stages ST1 and ST2.

Referring to FIG. 13, the scan control signal CS1 may include a first control signal SCS1. The timing controller T-CON may generate the first control signal SCS1 to be provided to the first scan driver SDV1.

The first stages (STi−3 to STi+4) may receive the first control signal SCS1, and may output the first scan signals (SCi−3 to SCi+4, SSi−3 to SSi+4) in response to the first control signal SCS1. In such an embodiment, the first stages (STi−3 to STi+4) may output first carry signals (CRi−3 to CRi+4) in response to the first control signal SCS1.

The first control signal SCS1 may include first to sixth clock signals CK1 to CK6, first to fourth signals S1 to S4, and a reset signal RT. The first to sixth clock signals CK1 to CK6 may be sequentially and repeatedly applied to the first stages (STi−3 to STi+4). In one embodiment, for example, the sixth clock signal CK6 may be applied to the (i−1)-th first stage (STi−1). The first to fifth clock signals CK1 to CK5 may be sequentially applied to i-th to (i+4)-th first stages (STi to STi+4), respectively.

The first signal S1 and the second signal S2 may be applied to each of the first stages (STi−3 to STi+4). The third signal S3 and the fourth signal S4 may be alternately applied to the first stages (STi−3 to STi+4). In one embodiment, for example, the third signal S3 may be applied to the i-th first stage STi. The fourth signal S4 may be applied to the (i+1)-th first stage STi+1.

The first stages (STi−3 to STi+4) may be connected in the same manner as one another. Accordingly, a connection relationship between the first stages (STi−3 to STi+4) will be described below focused on the i-th first stage STi.

The i-th first stage STi may receive a first carry signal of a previous first stage. The previous first stage may be a first stage that is earlier than the current first stage by at least one or more stages. In an embodiment of the first scan driver SDV1, the previous first stage is defined as a first stage that is earlier than the current stage by three stages. In one embodiment, for example, the i-th first stage STi may operate in response to the (i−3)-th first carry signal CRi−3 output from the (i−3)-th first stage (STi−3).

Each of the other first stages may receive the first carry signal of the previous first stage in the same manner. In one embodiment, for example, the (i+1)-th first stage (STi+1) may operate in response to the (i−2)-th first carry signal (CRi−2) output from the (i−2)-th first stage (STi−2).

The i-th first stage STi may receive the first carry signal of a next first stage. The next first stage may be a first stage that is later than the current stage by at least one or more stages. In an embodiment of the first scan driver SDV1, the next first stage is defined as a first stage that is later than the current stage by four stages. In one embodiment, for example, the i-th first stage STi may operate in response to the (i+4)-th first carry signal (CRi+4) output from the (i+4)-th first stage (STi+4).

Each of the other first stages may receive the first carry signal of the next first stage in the same manner. In one embodiment, for example, the (i+1)-th first stage (STi+1) may operate in response to the (i+5)-th first carry signal (CRi+5) output from the (i+5)-th first stage.

Referring to FIGS. 13 and 14, the first, second, and third dummy stages DST1, DST2, and DST3 may be arranged before a 1st first stage ST1. The first, second, and third dummy stages DST1, DST2, and DST3 may output the first, second, and third dummy carry signals CRD1, CRD2, and CRD3, respectively.

The first, second, and third dummy stages DST1, DST2, and DST3 may not be connected to the scan lines SL1 to SLm. The first, second, and third dummy stages DST1, DST2, and DST3 may not output the first scan signals (SC1 to SCm, SS1 to SSm).

In an embodiment, the carry signal of the previous stage that is input to the 1st first stage ST1 may be a first dummy carry signal CRD1 output from the first dummy stage DST1. In such an embodiment, the carry signal of the previous stage that is input to a 2nd first stage ST2 may be a second dummy carry signal CRD2 output from the second dummy stage DST2. Although not illustrated, the carry signal of the previous stage input to the 3rd first stage may be a third dummy carry signal CRD3 output from the third dummy stage DST3.

The first stages (ST1, ST2, STi−3 to STi+4) and the first, second, and third dummy stages DST1, DST2, and DST3 may be initialized in response to the reset signal RT.

A start signal STV may be applied as an operating signal to the first dummy stage DST1. In one embodiment, for example, the first dummy stage DST1 may operate by receiving the start signal STV and may output the first dummy carry signal CRD1.

In an embodiment, for the first operation of stages ST1 to STm, the first dummy carry signal CRD1 is desired to be output from the first dummy stage DST1. Accordingly, in such an embodiment, the start signal STV may be used. The start signal STV may be used as a carry signal of a previous stage for the first dummy stage DST1.

Operations of the first stages (STi−3 to STi+4) according to the timing of the first control signal SCS1 will be described in detail below with reference to FIGS. 15A, 15B, 16, and 17.

Figure 15A:
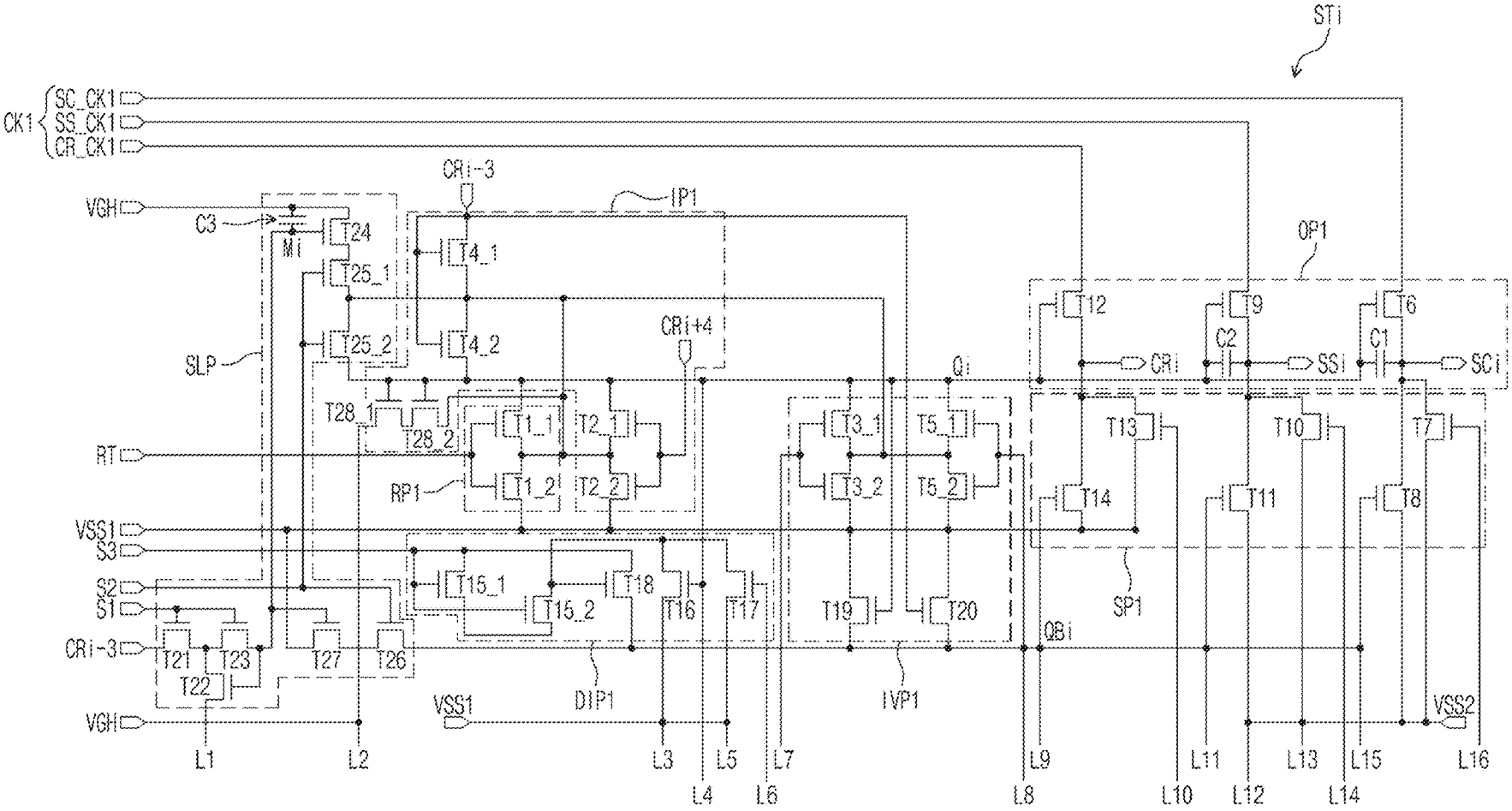
FIG. 15A is an equivalent circuit diagram of an i-th first stage shown in FIG. 13.
Figure 15B:
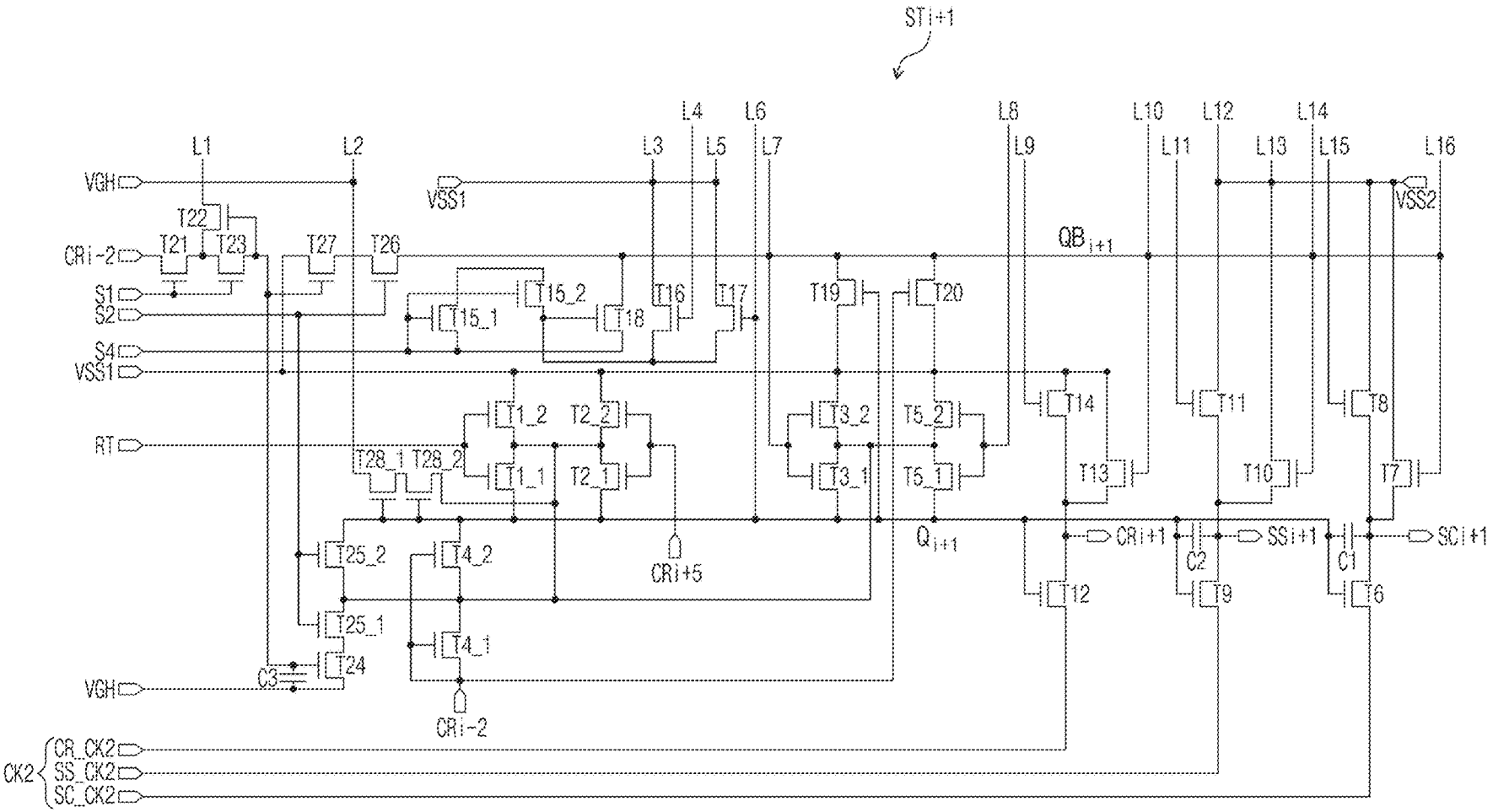
FIG. 15B is an equivalent circuit diagram of an (i+1)-th first stage shown in FIG. 13.
Figure 16:
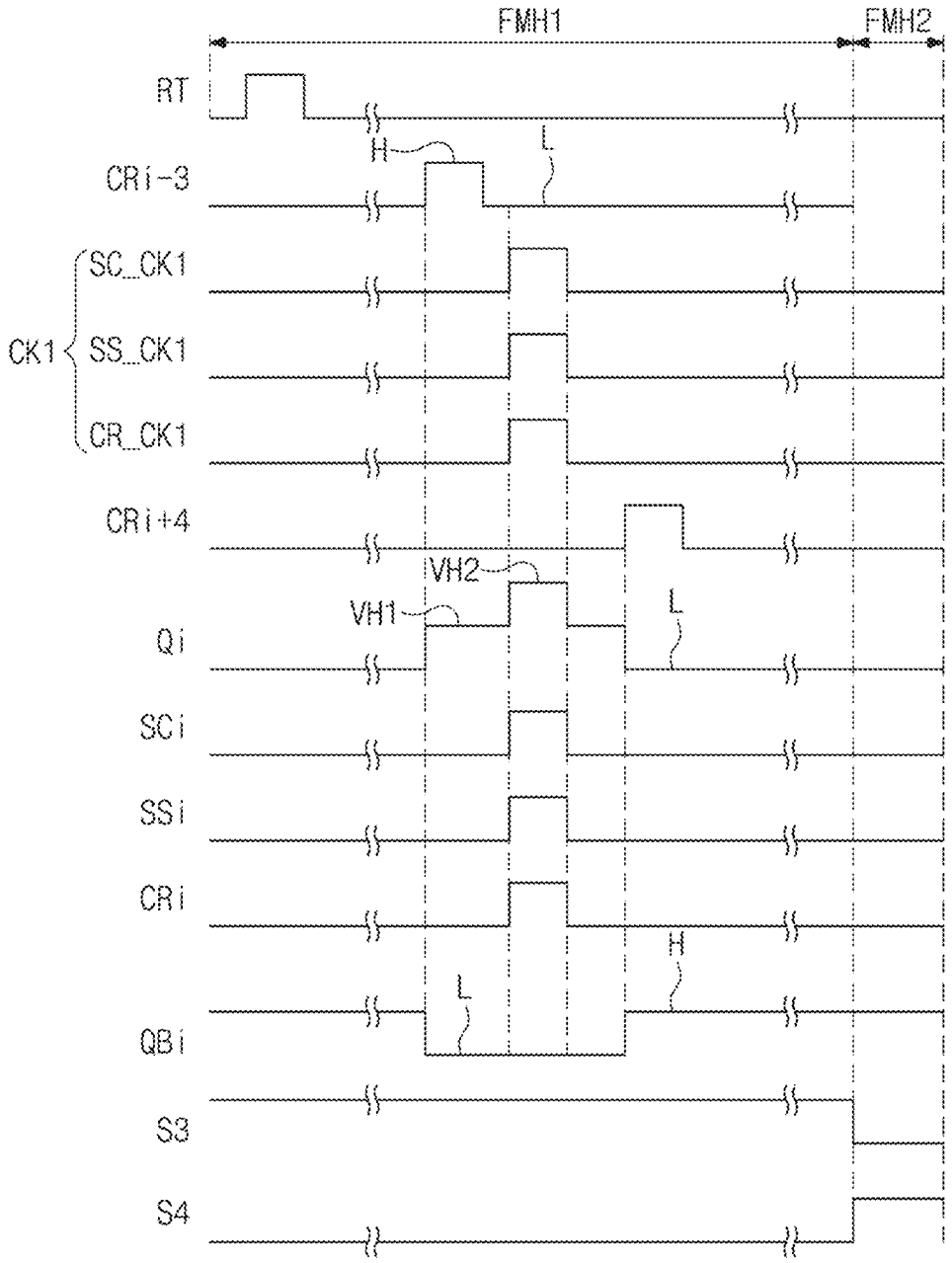
FIG. 16 is a signal timing diagram of signals for describing an operation in which an i-th first stage shown in FIG. 15A outputs first scan signals.
Figure 17:
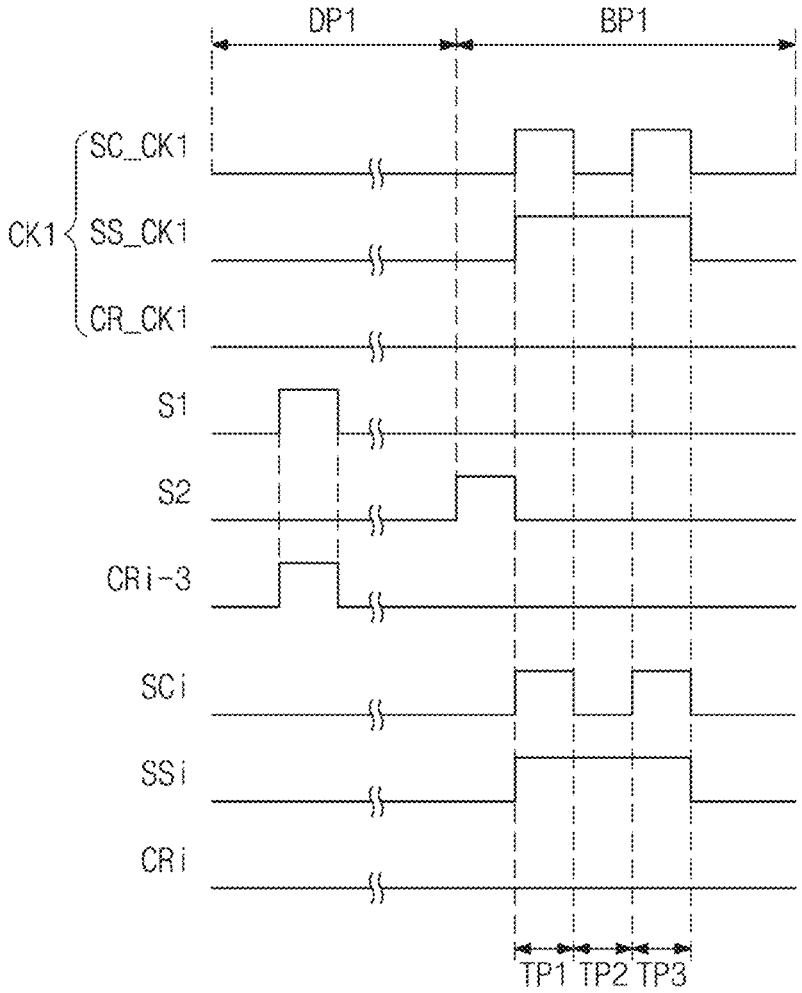
FIG. 17 is a signal timing diagram of signals for describing an operation in which an i-th first stage shown in FIG. 15A outputs a sensing scan signal.

FIG. 15A is an equivalent circuit diagram of an i-th first stage shown in FIG. 13. FIG. 15B is an equivalent circuit diagram of an (i+1)-th first stage shown in FIG. 13. FIG. 16 is a signal timing diagram of signals for describing an operation in which an i-th first stage shown in FIG. 15A outputs first scan signals. FIG. 17 is a signal timing diagram of signals for describing an operation in which an i-th first stage shown in FIG. 15A outputs a sensing scan signal.

Referring to FIGS. 15A and 15B, the i-th first stage STi may be an odd-numbered stage. The (i+1)-th first stage (STi+1) may be an even-numbered stage. A circuit of the i-th first stage STi may be substantially the same as a circuit of the (i+1)-th first stage (STi+1).

The i-th first stage STi and the (i+1)-th first stage (STi+1) may be connected to each other and may have a mirror structure. In one embodiment, for example, the circuit of the i-th first stage STi and the circuit of the (i+1)-th first stage (STi+1) may be substantially identical to each other and may be connected to each other in a symmetrical structure. Accordingly, an equivalent circuit of the i-th first stage STi of FIG. 15A will be described below.

The equivalent circuit diagram of the i-th first stage STi and an equivalent circuit diagram of the (i+1)-th first stage (STi+1) are separately shown in FIGS. 15A and 15B. However, a plurality of wiring numerals/symbols L1 to L16 are displayed on wirings arranged at a boundary between the equivalent circuit diagram in FIG. 15A and the equivalent circuit diagram in FIG. 15B to clearly show the connection relationship.

Referring to FIGS. 15A and 16, the i-th first stage STi may include a plurality of transistors T1_1 to T28_2 and a plurality of capacitors C1 to C3. In an embodiment, the i-th first stage STi may be divided into blocks, for example, the i-th first stage STi may include a first reset part RP1, a first input part IP1, a first output part OP1, a first stabilization part SP1, a first inverter part IVP1, a first dummy input part DIP1, and a sensing line selection part SLP.

The first reset part RP1 may be connected to a Q node Qi, and may receive the reset signal RT and a first low voltage VSS1. The i-th first stage STi may be initialized in response to the reset signal RT. In one embodiment, for example, the first reset part RP1 may initialize the Q node Qi to the first low voltage VSS1 in response to the reset signal RT.

For the operation of the first reset part RP1, the first reset part RP1 may include a first first transistor T1_1 and a second first transistor T1_2. The first and second first transistors T1_1 and T1_2 may be connected to each other in series between the Q node Qi and a terminal that receives the first low voltage VSS1. This structure may be defined as a dual gate transistor part. In such an embodiment, the leakage current of the first first and second first transistors T1_1 and T1_2 may be reduced.

Two transistors connected to each other in series to be described later may be defined as a dual gate transistor part.

A control electrode of the first first transistor T1_1 and a control electrode of the second first transistor T1_2 may receive the reset signal RT. A first electrode of the first first transistor T1_1 may be connected to the Q node Qi. A second electrode of the first first transistor T1_1 may be connected to a first electrode of the second first transistor T1_2. A second electrode of the second first transistor T1_2 may receive the first low voltage VSS1.

The first and second first transistors T1_1 and T1_2 may be turned on by the reset signal RT. The Q node Qi may be initialized by being discharged to the first low voltage VSS1 by the turned-on first and second first transistors T1_1 and T1_2.

The first input part IP1 may be connected to the Q node Qi to receive the (i−3)-th first carry signal (CRi−3) of the previous first stage (STi−3), the (i+4)-th first carry signal (CRi+4) of the next first stage (STi+4), the first low voltage VSS1, and a high voltage VGH. The first input part IP1 may charge the Q node Qi in response to the (i−3)-th first carry signal (CRi−3). The first input part IP1 may discharge the Q node Qi to the first low voltage VSS1 in response to the (i+4)-th first carry signal (CRi+4).

For the operation of the first input part IP1, the first input part IP1 may include a first second transistor T2_1, a second second transistor T2_2, a first fourth transistor T4_1, and a second fourth transistor T4_2.

The first and second second transistors T2_1 and T2_2 may be connected to each other in series between the Q node Qi and the terminal that receives the first low voltage VSS1. The first and second fourth transistors T4_1 and T4_2 may be connected to each other in series between the input terminal of the (i−3)-th first carry signal (CRi−3) and the Q node Qi.

A control electrode of the first second transistor T2_1 and a control electrode of the second second transistor T2_2 may receive the (i+4)-th first carry signal (CRi+4) of the next first stage (STi+4). A first electrode of the first second transistor T2_1 may be connected to the Q node Qi. A second electrode of the first second transistor T2_1 may be connected to a first electrode of the second second transistor T2_2 and the second electrode of the first first transistor T1_1. A second electrode of the second second transistor T2_2 may receive the first low voltage VSS1.

A first electrode and a control electrode of the first fourth transistor T4_1 may receive the (i−3)-th first carry signal CRi−3 of the previous first stage STi−3. A second electrode of the first fourth transistor T4_1 may be connected to a first electrode of the second fourth transistor T4_2 and the second electrode of the first second transistor T2_1. A control electrode of the second fourth transistor T4_2 may receive the (i−3)-th first carry signal CRi−3. A second electrode of the second fourth transistor T4_2 may be connected to the Q node Qi.

The first fourth and second fourth transistors T4_1 and T4_2 may be turned on by the (i−3)-th first carry signal CRi−3. The Q node Qi may be charged to the high-level voltage of the (i−3)-th first carry signal CRi−3 through the turned-on first fourth and second fourth transistors T4_1 and T4_2. In one embodiment, for example, the Q node Qi may be charged to a first high voltage VH1.

The first and second second transistors T2_1 and T2_2 may be turned on by the (i+4)-th first carry signal (CRi+4). The voltage of the Q node Qi may be discharged to the first low voltage VSS1 by the turned-on first and second second transistors T2_1 and T2_2. Accordingly, the voltage of the Q node Qi may be discharged to a low level.

The first input part IP1 may further include first 28th and second 28th transistors T28_1 and T28_2. Control electrodes of the first 28th and second 28th transistors T28_1 and T28_2 may be connected to the Q node Qi. A first electrode of the first 28th transistor T28_1 may receive the high voltage VGH. A second electrode of the first 28th transistor T28_1 may be connected to a first electrode of the second 28th transistor T28_2. A second electrode of the second 28th transistor T28_2 may be connected to the second electrode of the first first transistor T1_1, the second electrode of the first second transistor T2_1, and the second electrode of the first fourth transistor T4_1.

The first and second second transistors T2_1 and T2_2 may be interposed between the Q node Qi and the terminal that receives the first low voltage VSS1. When the Q node Qi is boosted by the first output part OP1 to be described later, the Q node Qi may be boosted to a second high voltage VH2. In this case, the voltage level may be rapidly changed from the second high voltage VH2 to the first low voltage VSS1 at both ends of the first and second second transistors T2_1 and T2_2, and thus the stress of the first and second second transistors T2_1 and T2_2 connected to each other in series may be increased.

The high voltage VGH may be provided to a contact between the first second transistor T2_1 and the second second transistor T2_2 through the first and second 28th transistors T28_1 and T28_2. The high voltage VGH may have a level between the second high voltage VH2 and the first low voltage VSS1. The voltage level of the contact between the first second transistor T2_1 and the second second transistor T2_2 may be set to the high voltage VGH level between the second high voltage VH2 and the first low voltage VSS1.

In this case, the voltage level may be rapidly changed to the second high voltage VH2, the high voltage VGH, and the first low voltage VSS1 at both ends of the first second and second second transistors T2_1 and T2_2, and thus the sudden change in voltage may be alleviated. Accordingly, the stress of the first second and second second transistors T2_1 and T2_2 that are connected to each other in series may be reduced. For the same reason, the high voltage VGH may be provided to the contact between the first first and second first transistors T1_1 and T1_2 of the first reset part RP1.

The first output part OP1 may be connected to the Q node Qi and may receive the first clock signal CK1. The first output part OP1 may boost the voltage charged at the Q node Qi in response to the first clock signal CK1 to output the i-th first scan signals (SCi, SSi) and the i-th first carry signal CRi.

For the operation of the first output part OP1, the first output part OP1 may include a sixth transistor T6, a ninth transistor T9, a twelfth transistor T12, a first capacitor C1, and a second capacitor C2.

The first clock signal CK1 may include a first sub clock signal SC_CK1, a second sub clock signal SS_CK1, and a third sub clock signal CR_CK1. The first sub clock signal SC_CK1, the second sub clock signal SS_CK1, and the third sub clock signal CR_CK1 may have a same timing as one another.

The second clock signal CK2 may also include a first sub clock signal SC_CK2, a second sub clock signal SS_CK2, and a third sub clock signal CR_CK2 having a same timing as one another. Each of the other clock signals CK3 to CK6 may also include a first sub clock signal, a second sub clock signal, and a third sub clock signal.

A control electrode of the sixth transistor T6 may be connected to the Q node Qi. A first electrode of the sixth transistor T6 may receive the first sub clock signal SC_CK1. A second electrode of the sixth transistor T6 may be connected to an output terminal of the i-th write scan signal SCi. A control electrode of the ninth transistor T9 may be connected to the Q node Qi. A first electrode of the ninth transistor T9 may receive the second sub clock signal SS_CK1. A second electrode of the ninth transistor T9 may be connected to an output terminal of the i-th sampling scan signal SSi.

A first electrode of the first capacitor C1 may be connected to the control electrode of the sixth transistor T6. A second electrode of the first capacitor C1 may be connected to the output terminal of the i-th write scan signal SCi. A first electrode of the second capacitor C2 may be connected to the control electrode of the ninth transistor T9. A second electrode of the second capacitor C2 may be connected to the output terminal of the i-th sampling scan signal SSi.

A control electrode of the twelfth transistor T12 may be connected to the Q node Qi. A first electrode of the twelfth transistor T12 may receive the third sub clock signal CR_CK1. A second electrode of the twelfth transistor T12 may be connected to an output terminal of the i-th first carry signal CRi.

The sixth, ninth, and twelfth transistors T6, T9, and T12 may be turned on by the voltage of the Q node Qi charged to the first high voltage VH1. The turned-on sixth, ninth, and twelfth transistors T6, T9, and T12 may receive the first sub clock signal SC_CK1, the second sub clock signal SS_CK1, and the third sub clock signal CR_CK1, respectively.

While the Q node Qi maintains the charged state, the activated high-level voltages of the first sub clock signal SC_CK1, the second sub clock signal SS_CK1, and the third sub clock signal CR_CK1 may be output as the i-th write scan signal SCi, the i-th sampling scan signal SSi, and the i-th first carry signal CRi, respectively.

The first and second capacitors C1 and C2 may perform boot-strapping on the voltage of the Q node Qi to the second high voltage VH2 higher than the first high voltage VH1, in synchronization with the activated high-level voltages of the first sub clock signal SC_CK1 and the second sub clock signal SS_CK1. When the voltage of the Q node Qi is boot-strapped, the first sub clock signal SC_CK1 and the second sub clock signal SS_CK1 may be output as the i-th write scan signal SCi and the i-th sampling scan signal SSi quickly and without distortion.

The first stabilization part SP1 may be connected to an output terminal of the i-th write scan signal SCi, an output terminal of the i-th sampling scan signal SSi, an output terminal of the i-th first carry signal CRi, and a QB node QBi. The first stabilization part SP1 may receive the first low voltage VSS1 and a second low voltage VSS2. The first low voltage VSS1 may have a level lower than the second low voltage VSS2.

The first stabilization part SP1 may be connected to a QB node (QBi+1) of the next first stage (STi+1) shown in FIG. 15B. The first stabilization part SP1 may discharge the output terminal of the i-th write scan signal SCi, the output terminal of the i-th sampling scan signal SSi, and the output terminal of the i-th first carry signal CRi to be stabilized.

For the operation of the first stabilization part SP1, the first stabilization part SP1 includes a seventh transistor T7, an eighth transistor T8, a tenth transistor T10, an eleventh transistor T11, a thirteenth transistor T13, and a fourteenth transistor T14.

A control electrode of the seventh transistor T7 may be connected to the QB node (QBi+1) of the next first stage (STi+1). A first electrode of the seventh transistor T7 may be connected to the output terminal of the i-th write scan signal SCi. A second electrode of the seventh transistor T7 may receive the second low voltage VSS2.

A control electrode of the eighth transistor T8 may be connected to the QB node QBi. A first electrode of the eighth transistor T8 may be connected to the output terminal of the i-th write scan signal SCi. A second electrode of the eighth transistor T8 may receive the second low voltage VSS2.

A control electrode of the tenth transistor T10 may be connected to the QB node (QBi+1) of the next first stage (STi+1). A first electrode of the tenth transistor T10 may be connected to the output terminal of the i-th sampling scan signal SSi. A second electrode of the tenth transistor T10 may receive the second low voltage VSS2.

A control electrode of the eleventh transistor T11 may be connected to the QB node QBi. A first electrode of the eleventh transistor T11 may be connected to the output terminal of the i-th sampling scan signal SSi. A second electrode of the eleventh transistor T11 may receive the second low voltage VSS2

A control electrode of the thirteenth transistor T13 may be connected to the QB node (QBi+1) of the next first stage (STi+1). A first electrode of the thirteenth transistor T13 may be connected to the output terminal of the i-th first carry signal CRi. A second electrode of the thirteenth transistor T13 may receive the first low voltage VSS1.

A control electrode of the fourteenth transistor T14 may be connected to the QB node QBi. A first electrode of the fourteenth transistor T14 may be connected to the output terminal of the i-th first carry signal CRi. A second electrode of the fourteenth transistor T14 may receive the first low voltage VSS1.

In accordance with a mirror structure, the seventh, eighth, tenth, eleventh, thirteenth, and fourteenth transistors T7, T8, T10, T11, T13, and T14 may be connected to seventh, eighth, tenth, eleventh, thirteenth, and fourteenth transistors T7, T8, T10, T11, T13, and T14 of the next first stage (STi+1), respectively.

The voltage level of the QB node QBi may be opposite to the voltage level of the Q node Qi. When the voltage level of the Q node Qi is a low level (L), the voltage level of the QB node QBi may be a high level (H), as shown in FIG. 16.

When the voltage level of the QB node QBi is the high level (H), the eighth, eleventh, and fourteenth transistors T8, T11, and T14 may be turned on. By the turned-on eighth and eleventh transistors T8 and T11, the output terminal of the i-th write scan signal SCi and the output terminal of the i-th sampling scan signal SSi are discharged to the second low voltage VSS2 to be stabilized.

By the turned-on fourteenth transistor T14, the output terminal of the i-th first carry signal CRi may be discharged to the first low voltage to be stabilized. The i-th first carry signal CRi may be used as an input signal of another stage. Accordingly, for stable signal output, the output terminal of the i-th first carry signal CRi may be further discharged to the first low voltage VSS1 having a level lower than the second low voltage VSS2, and thus may be further stabilized.

The seventh, tenth, and thirteenth transistors T7, T10, and T13 may further discharge the output terminal of the i-th write scan signal SCi, the output terminal of the i-th sampling scan signal SSi, and the output terminal of the i-th first carry signal CRi by being turned on depending on the voltage of the QB node (QBi+1) of the next first stage (STi+1).

The first inverter part IVP1 may be connected to the Q node Qi and the QB node QBi and may receive the first low voltage VSS1. Also, the first inverter part IVP1 may be connected to the QB node (QBi+1) of the next first stage (STi+1) shown in FIG. 15B. The first inverter part IVP1 may invert the voltages of the Q node Qi and the QB node QBi.

For the operation of the first inverter part IVP1, the first inverter part IVP1 may include first third and second third transistors T3_1 and T3_2, which are connected to each other in series, first fifth and second fifth transistors T5_1 and T5_2, which are connected to each other in series, a nineteenth transistor T19, and a twentieth transistor T20.

Control electrodes of the first third and second third transistors T3_1 and T3_2 may be connected to the QB node (QBi+1) of the next first stage (STi+1). A first electrode of the first third transistor T3_1 may be connected to the Q node Qi. A second electrode of the first third transistor T3_1 may be connected to a first electrode of the second third transistor T3_2. A second electrode of the second third transistor T3_2 may receive the first low voltage VSS1. The second electrode of the first third transistor T3_1 may be connected to the second electrode of the second 28th transistor T28_2.

Control electrodes of the first fifth and second fifth transistors T5_1 and T5_2 may be connected to the QB node QBi. A first electrode of the first fifth transistor T5_1 may be connected to the Q node Qi. A second electrode of the first fifth transistor T5_1 may be connected to a first electrode of the second fifth transistor T5_2. A second electrode of the second fifth transistor T5_2 may receive the first low voltage VSS1. The second electrode of the first fifth transistor T5_1 may be connected to the second electrode of the second 28th transistor T28_2.

In accordance with a mirror structure, the first third and second third transistors T3_1 and T3_2 may be connected to the first third and second third transistors T3_1 and T3_2 of the next first stage (STi+1) through the QB node (QBi+1) of the next first stage (STi+1). In addition, the first fifth and second fifth transistors T5_1 and T5_2 may be connected to the first fifth and second fifth transistors T5_1 and T5_2 of the next first stage (STi+1) through the QB node QBi.

A control electrode of the nineteenth transistor T19 may be connected to the Q node Qi. A first electrode of the nineteenth transistor T19 may receive the first low voltage VSS1. A second electrode of the nineteenth transistor T19 may be connected to the QB node QBi.

A control electrode of the twentieth transistor T20 may receive the first carry signal CRi−3. A first electrode of the twentieth transistor T20 may receive the first low voltage VSS1. A second electrode of the twentieth transistor T20 may be connected to the QB node QBi.

The twentieth transistor T20 may be turned on by the (i−3)-th first carry signal CRi−3. The QB node QBi may be discharged to the first low voltage VSS1 by the turned-on twentieth transistor T20 to have the low level (L). When the Q node Qi has the first high voltage VH1 and the second high voltage VH2, the nineteenth transistor T19 may be turned on by the voltage of the Q node Qi. The QB node QBi may be further discharged to the first low voltage VSS1 by the turned-on nineteenth transistor T19.

When the QB node QBi is the high level (H), the first fifth and second fifth transistors T5_1 and T5_2 may be turned on by the voltage of the QB node QBi. The Q node Qi may be discharged to the first low voltage VSS1 by the turned-on first fifth and second fifth transistors T5_1 and T5_2 to have the low level (L). When the voltage of the QB node (QBi+1) of the next first stage (STi+1) is the high level (H), the first third and second third transistors T3_1 and T3_2 may be turned on to further discharge the Q node Qi to the first low voltage VSS1.

The first dummy input part DIP1 may provide the third signal S3 to the QB node QBi. When the Q node Qi has the first high voltage VH1 and the second high voltage VH2, the first dummy input part DIP1 may block the third signal S3 such that the third signal S3 is not provided to the QB node QBi.

For the operation of the first dummy input part DIP1, the first dummy input part DIP1 may include first fifteenth and second fifteenth transistors T15_1 and T15_2, a sixteenth transistor T16, a seventeenth transistor T17, and an eighteenth transistor T18.

Control electrodes of the first fifteenth and second fifteenth transistors T15_1 and T15_2 may receive the third signal S3. A first electrode of the first fifteenth transistor T15_1 may receive the third signal S3. A second electrode of the first fifteenth transistor T15_1 may be connected to a first electrode of the second fifteenth transistor T15_2. A second electrode of the second fifteenth transistor T15_2 may be connected to a control electrode of the eighteenth transistor T18.

A first electrode of the eighteenth transistor T18 may receive the third signal S3. A second electrode of the eighteenth transistor T18 may be connected to the QB node QBi.

A control electrode of the sixteenth transistor T16 may be connected to the Q node Qi. A first electrode of the sixteenth transistor T16 may be connected to a control electrode of the eighteenth transistor T18. A second electrode of the sixteenth transistor T16 may receive the first low voltage VSS1.

A control electrode of the seventeenth transistor T17 may be connected to the Q node (Qi+1) of the next first stage (STi+1). A first electrode of the seventeenth transistor T17 may be connected to the control electrode of the eighteenth transistor T18. A second electrode of the seventeenth transistor T17 may receive the first low voltage VSS1.

In accordance with the mirror structure, the sixteenth and seventeenth transistors T16 and T17 may be connected to the sixteenth and seventeenth transistors T16 and T17 of the next first stage (STi+1).

The first fifteenth and second fifteenth transistors T15_1 and T15_2 and the eighteenth transistor T18 may be turned on by the third signal S3, and thus the activated QB node QBi may have the high level (H).

The third signal S3 may be inverted for each frame. In one embodiment, for example, during a current frame FMH1, the third signal S3 may have a high level. During a next frame FMH2, the third signal S3 may have a low level.

When the high-level signal is continuously applied to the first fifteenth and second fifteenth transistors T15_1 and T15_2 and the eighteenth transistor T18, the stress of the first fifteenth and second fifteenth transistors T15_1 and T15_2 and the eighteenth transistor T18 may be increased. Accordingly, the third signal S3 may have a low level during the next frame FMH2 to prevent such a stress.

The fourth signal S4 applied to the next first stage (STi+1) may have a level opposite to that of the third signal S3. The fourth signal S4 may have a low level during the current frame FMH1, and may have a high level during the next frame FMH2. The voltage level of the QB node (QBi+1) of the next first stage (STi+1) may be determined by the fourth signal S4. The first stabilization part SP1 and the first inverter part IVP1 may be operated based on the voltage level of the QB node (QBi+1) of the next first stage (STi+1).

When the Q node Qi has the first high voltage VH1 and the second high voltage VH2, the sixteenth transistor T16 may be turned on by the voltage of the Q node Qi. The first low voltage VSS1 may be applied to the control electrode of the eighteenth transistor T18 by the turned-on sixteenth transistor T16. Accordingly, the eighteenth transistor T18 may be turned off, and thus the third signal S3 may be blocked without being provided to the QB node QBi.

In addition, the seventeenth transistor T17 may be turned on by the voltage of the Q node (Qi+1) of the next first stage (STi+1). The first low voltage VSS1 may be applied to the control electrode of the eighteenth transistor T18 by the turned-on seventeenth transistor T17. Accordingly, the eighteenth transistor T18 may be turned off by the seventeenth transistor T17, and thus the third signal S3 may be blocked without being provided to the QB node QBi.

Referring to FIGS. 15A and 17, the sensing line selection part SLP may charge the selected carry signal in response to the first signal S1 during the first display period DP1 and may be connected to the Q node Qi in response to the second signal S2.

For this operation, the sensing line selection part SLP may include a 21st transistor T21, a 22nd transistor T22, a 23rd transistor T23, a 24th transistor T24, first 25th and second 25th transistors T25_1 and T25_2, a 26th transistor T26, a 27th transistor T27, and a third capacitor C3.

A control electrode of the 21st transistor T21 and a control electrode of the 23rd transistor T23 may receive the first signal S1. A first electrode of the 21st transistor T21 may receive the (i−3)-th first carry signal CRi−3 of the previous first stage (STi−3). A second electrode of the 21st transistor T21 may be connected to a first electrode of the 23rd transistor T23. A second electrode of the 23rd transistor T23 may be connected to a control electrode of the 24th transistor T24.

A control electrode of the 22nd transistor T22 may be connected to the second electrode of the 23rd transistor T23. A first electrode of the 22nd transistor T22 may be connected to the first electrode of the 23rd transistor T23. A second electrode of the 22nd transistor T22 may be connected to the second electrode of the 22nd transistor T22 of the next first stage (STi+1).

A first electrode of the 24th transistor T24 may receive the high voltage VGH. A second electrode of the 24th transistor T24 may be connected to a first electrode of the first 25th transistor 25_1.

A control electrode of the first 25th transistor 25_1 and the control electrode of the second 25th transistor 25_2 may receive the second signal S2. A second electrode of the first 25th transistor 25_1 may be connected to a first electrode of the second 25th transistor 25_2 and the second electrode of the first fourth transistor T4_1. A second electrode of the second 25th transistor 25_2 may be connected to the Q node Qi.

A first electrode of the third capacitor C3 may receive the high voltage VGH. A second electrode of the third capacitor C3 may be connected to the control electrode of the 24th transistor T24.

A control electrode of the 27th transistor T27 may be connected to the control electrode of the 24th transistor T24. A first electrode of the 27th transistor T27 may receive the first low voltage VSS1. A second electrode of the 27th transistor T27 may be connected to a first electrode of the 26th transistor T26.

A control electrode of the 26th transistor T26 may receive the second signal S2. A second electrode of the 26th transistor T26 may be connected to the QB node QBi.

The first signal S1 may overlap one of a plurality of first carry signals. The overlapping carry signal may be changed during each frame. During a current frame, the first signal S1 may overlap the (i−3)-th first carry signal (CRi−3). During a next frame, the first signal S1 may overlap another first carry signal other than the (i−3)-th first carry signal CRi−3. That is, the first signal S1 may randomly overlap one of the first carry signals.

The first signal S1 may overlap the (i−3)-th first carry signal CRi−3, and thus the pixels PX connected to the i-th first stage STi may be selected as sensing pixels. This selection operation will be described later.

During the first display period DP1, the 21st and 23rd transistors T21 and T23 may be turned on in response to the first signal S1. The high-level voltage of the (i−3)-th first carry signal (CRi−3) may be charged to a M node Mi through the turned-on 21st and 23rd transistors T21 and T23. The third capacitor C3 may maintain the voltage charged in the M node Mi.

During the first display period DP1, the second signal S2 may have a low level. Accordingly, the first 25th and second 25th transistors T25_1 and T25_2 and the 26th transistor T26 may be turned off. The 22nd transistor T22, the 24th transistor T24, and the 27th transistor T27 may be turned on based on the voltage charged in the M node Mi. The first 25th and second 25th transistors T25_1 and T25_2 and the 26th transistor T26 are turned off, and thus the sensing line selection part SLP may not be connected to the Q node Qi and the QB node QBi.

The second signal S2 may be activated during the first blank period BP1 to turn on the first 25th and second 25th transistors T25_1 and T25_2 and the 26th transistor T26. Accordingly, the sensing line selection part SLP may be connected to the Q node Qi and the QB node QBi. The first 25th and second 25th transistors T25_1 and T25_2 are turned on during the first blank period BP1 while the 24th transistor T24 is turned on by the voltage charged in the M node Mi. Accordingly, the Q node Qi may be charged to the high voltage VGH.

The sixth, ninth, and twelfth transistors T6, T9, and T12 may be turned on by the voltage charged at the Q node Qi. During the first blank period BP1, the turned-on sixth and ninth transistors T6 and T9 may receive the first sub clock signal SC_CK1 and the second sub clock signal SS_CK1, respectively. During the first blank period BP1, the third sub clock signal CR_CK1 may maintain a low level.

During the first blank period BP1, the first sub clock signal SC_CK1 may be activated during the first and third periods TP1 and TP3 and may be deactivated during the second period TP2. During the first blank period BP1, the second sub clock signal SS_CK1 may be activated during the first, second, and third periods TP1, TP2, and TP3.

During the first blank period BP1, high-level voltages of the first sub clock signal SC_CK1 and the second sub clock signal SS_CK1 may be output as the i-th write scan signal SCi and the i-th sampling scan signal SSi while the Q node Qi is charged.

The i-th write scan signal SCi and the i-th sampling scan signal SSi that are output during the first blank period BP1 may be applied to the pixels PX connected to the i-th first stage STi. As a result, the pixels PX connected to the i-th first stage STi may be selected as the pixels PX for a sensing operation to perform the above-described sensing operation.

Figure 18:
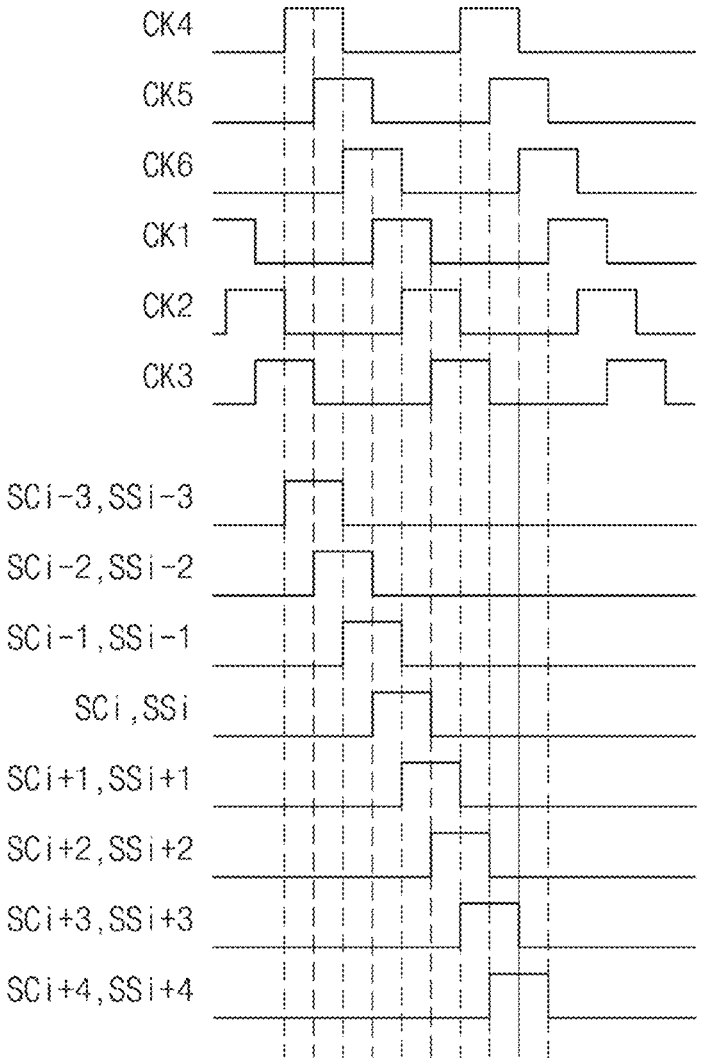
FIG. 18 is a signal timing diagram of first scan signals output from first stages depending on clock signals shown in FIG. 13.

FIG. 18 is a signal timing diagram of first scan signals output from first stages depending on clock signals shown in FIG. 13.

Referring to FIGS. 13 and 18, in accordance with the operation described in FIG. 15A, the first scan signals (SCi−3 to SCi+4, SSi−3 to SSi+4) may be sequentially output in the first stages (STi−3 to STi+4). The first scan signals (SCi−3 to SCi+4, SSi−3 to SSi+4) may be sequentially output in synchronization with the first to sixth clock signals CK1 to CK6.

Figure 19:
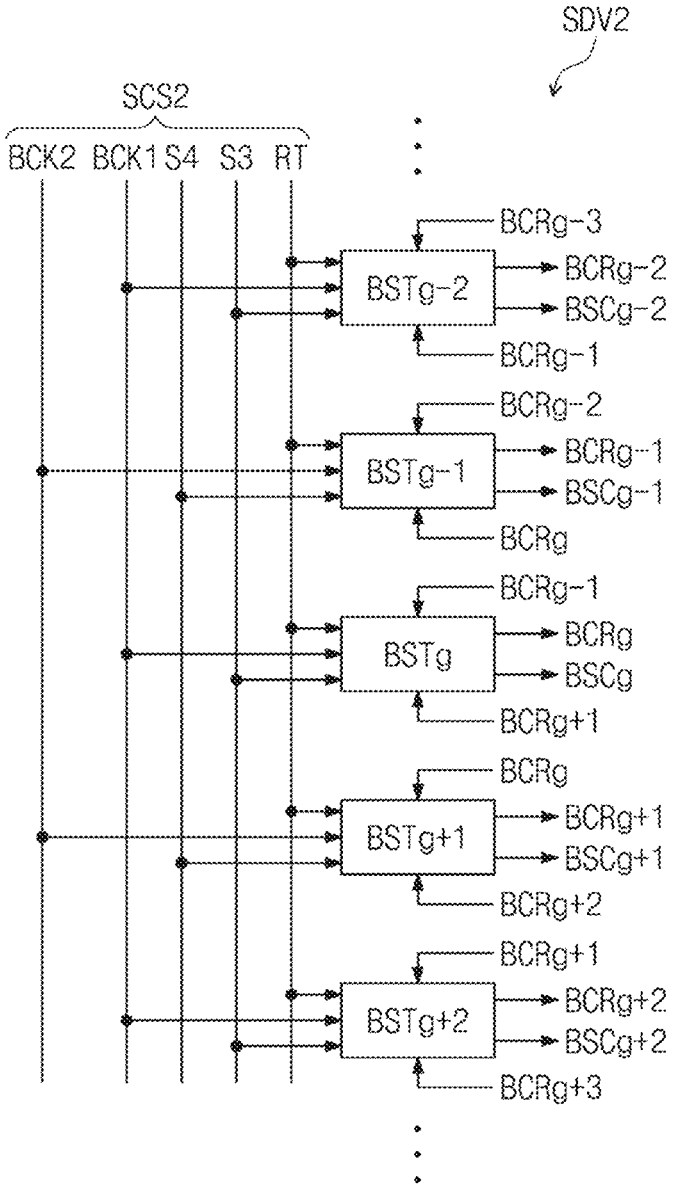
FIG. 19 is a diagram illustrating a connection relationship between second stages of a second scan driver shown in FIG. 12.

FIG. 19 is a diagram illustrating a connection relationship between second stages of a second scan driver shown in FIG. 12.

FIG. 19 illustrates five second stages (BSTg−2 to BSTg+2) among the second stages of the second scan driver SDV2, for convenience of illustration.

Referring to FIG. 19, the scan control signal CS1 may include a second control signal SCS2. The timing controller T-CON may generate the second control signal SCS2 to be provided to the second scan driver SDV2.

The second stages (BSTg−2 to BSTg+2) may receive the second control signal SCS2 and may output second scan signals (BSCg−2 to BSCg+2) in response to the second control signal SCS2. Also, the second stages (BSTg−2 to BSTg+2) may output second carry signals (BCRg−2 to BCRg+2) in response to the second control signal SCS2.

The second control signal SCS2 may include first and second clock signals BCK1 and BCK2, third and fourth signals S3 and S4, and the reset signal RT. The third and fourth signals S3 and S4 and the reset signal RT may be the same as the third and fourth signals S3 and S4 and the reset signal RT described with reference to FIGS. 13 and 16. The second scan driver SDV2 is not related to the sensing operation of the pixels PX, and thus may not receive the first signal S1 and the second signal S2.

The first clock signal BCK1 and the second clock signal BCK2 may be alternately applied to the second stages (BSTg−2 to BSTg+2). The reset signal RT may be applied to the second stages (BSTg−2 to BSTg+2). The third signal S3 and the fourth signal S4 may be alternately applied to the second stages (BSTg−2 to BSTg+2).

The second stages (BSTg−2 to BSTg+2) may be connected in the same manner as one another. Hereinafter, a connection relationship between the second stages (BSTg−2 to BSTg+2) will be described focused on a g-th second stage BSTg.

The g-th second stage BSTg may receive a (g−1)-th second carry signal (BCRg−1) output from the (g−1)-th second stage (BSTg−1) that is the previous second stage. The g-th second stage BSTg may receive a (g+1)-th second carry signal (BCRg+1) output from the (g+1)-th second stage (BSTg+1) that is the next second stage.

Other stages may receive the second carry signal of the previous second stage and the second carry signal of the next second stage in a same manner as that described above.

Figure 20:
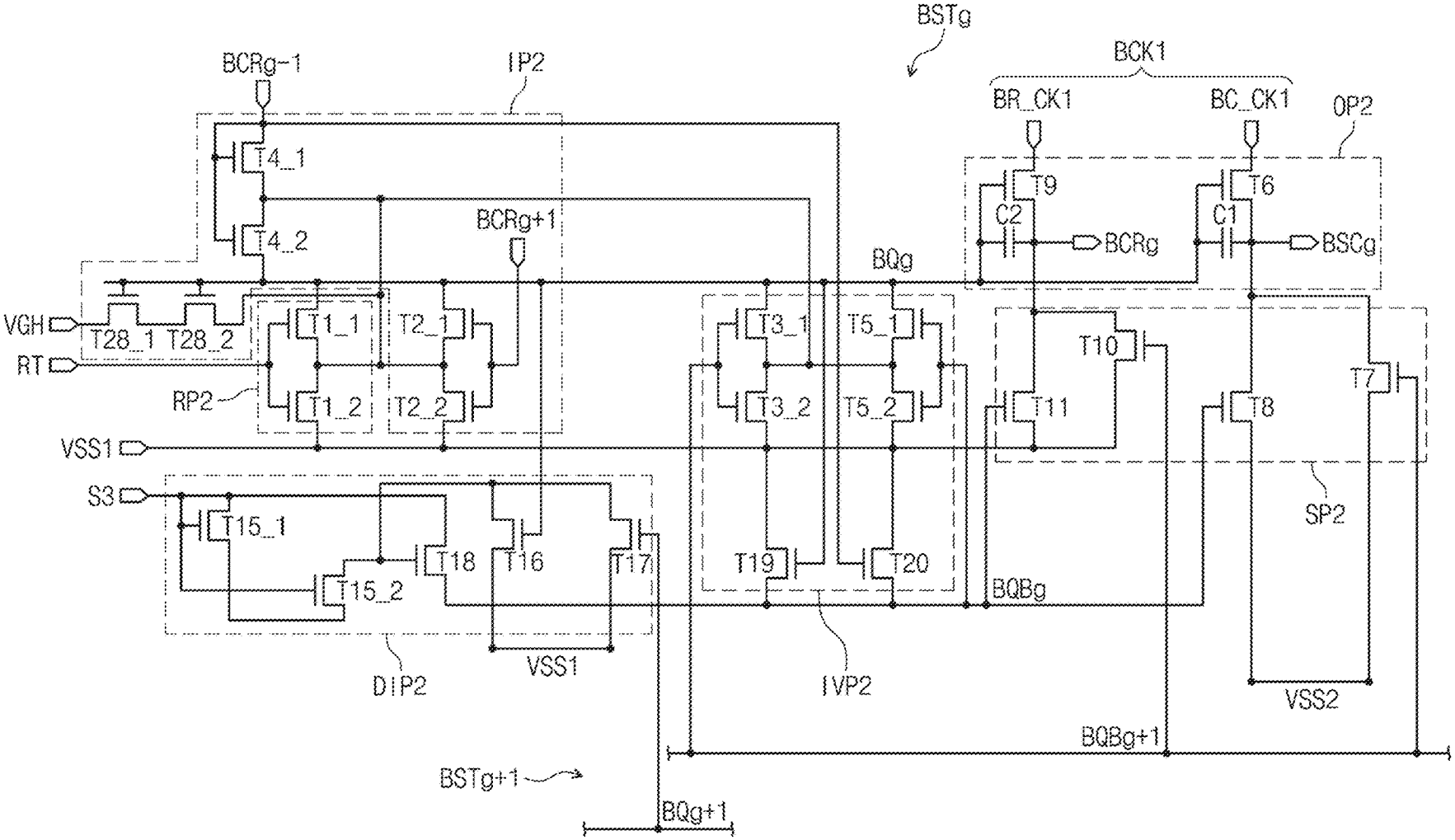
FIG. 20 is an equivalent circuit diagram of a g-th second stage shown in FIG. 19.
Figure 21:
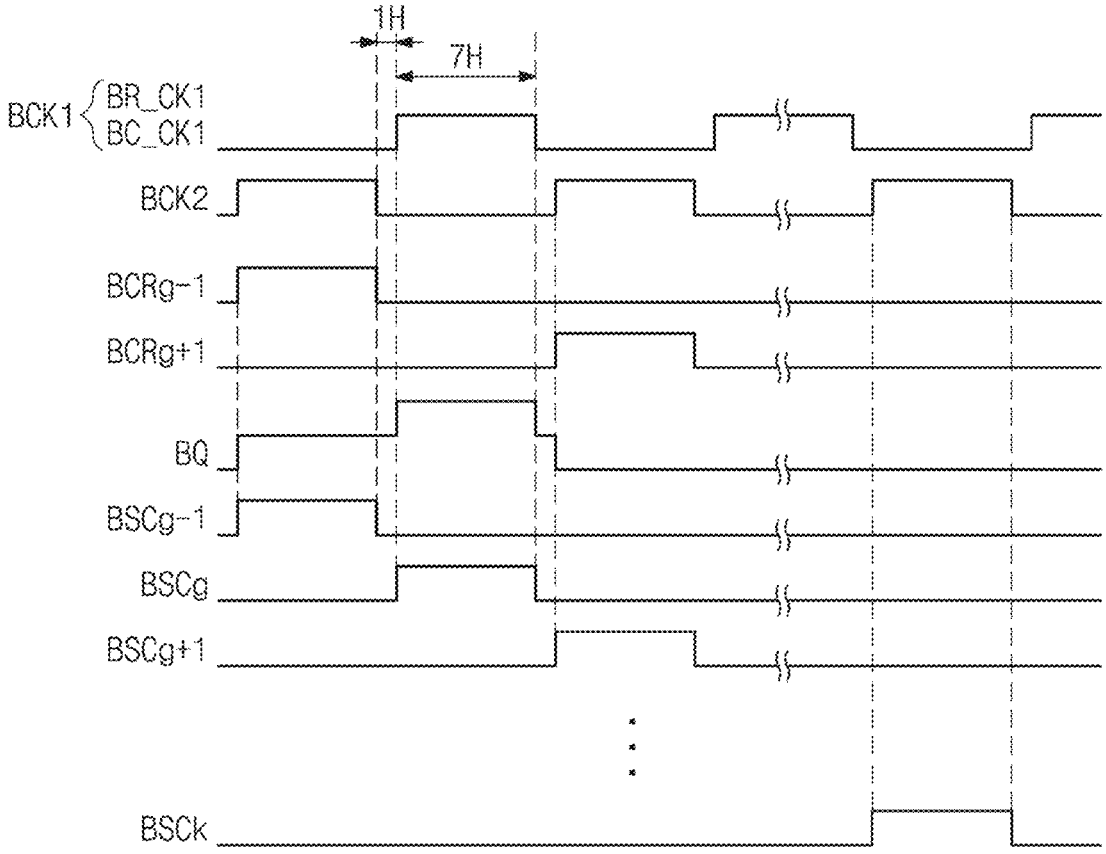
FIG. 21 is a signal timing diagram of signals for describing an output operation of a second scan signal of a g-th second stage shown in FIG. 20.

FIG. 20 is an equivalent circuit diagram of a g-th second stage shown in FIG. 19. FIG. 21 is a signal timing diagram of signals for describing an output operation of a second scan signal of a g-th second stage shown in FIG. 20.

Referring to FIGS. 20 and 21, the g-th second stage BSTg may include a plurality of transistors (T1_1 to T5_2, T6-T11, T15_1 to T20, T28_1, T28_2) and first and second capacitors C1 and C2. The equivalent circuit of the g-th second stage BSTg may be the same as a circuit obtained by removing twelfth to fourteenth transistors T12 to T14, 21st to 27th transistors T21 to T27, and the third capacitor C3 from the i-th first stage STi of FIG. 15A. Accordingly, any repetitive detailed description of the connection relationship between a plurality of transistors (T1_1 to T5_2, T6 to T11, T15_1 to T20, T28_1, T28_2) and the first and second capacitors C1 and C2 will be omitted to avoid redundancy.

For convenience of illustration, FIG. 20 shows only a BQ node (BQg+1) and a BQB node (BQBg+1) of the (g+1)-th second stage (BSTg+1) that is the next stage of the g-th second stage BSTg. However, similarly to the first stages (STi, STi+1) shown in FIGS. 15A and 15B, a structure of the (g+1)-th second stage (BSTg+1) may be substantially the same as that of the g-th second stage BSTg.

Similarly to the i-th first stage STi shown in FIG. 15A, the seventh and tenth transistors T7 and T10 may be connected to the BQB node (BQBg+1) of the (g+1)-th second stage (BSTg+1) that is the next stage. In one embodiment, for example, control electrodes of the seventh and tenth transistors T7 and T10 may be connected to the BQB node (BQBg+1) of the (g+1)-th second stage (BSTg+1) that is the next stage.

Furthermore, similarly to the i-th first stage STi shown in FIG. 15A, the seventeenth transistor T17 of the g-th second stage BSTg may be connected to the BQ node (BQg+1) of the (g+1)-th second stage (BSTg+1) that is the next stage. In one embodiment, for example, a control electrode of the seventeenth transistor T17 may be connected to the BQ node (BQg+1) of the (g+1)-th second stage (BSTg+1) that is the next stage.

Similarly to the operations of the first stages (STi, STi+1), the output terminal of the g-th second scan signal BSCg and the output terminal of the g-th second carry signal BCRg may be discharged by the eighth and eleventh transistors T8 and T11, and the output terminal of the g-th second scan signal BSCg and the output terminal of the g-th second carry signal BCRg may be further discharged by the seventh and tenth transistors T7 and T10. Similarly to the operations of the first stages (STi, STi+1), the eighteenth transistor T18 may be turned off by the sixteenth transistor T16 and the seventeenth transistor T17, and thus the third signal S3 may be blocked without being provided to the BQB node BQBg.

In an embodiment, the g-th second stage BSTg may be divided into blocks, for example, the g-th second stage BSTg may include a second reset part RP2, a second input part IP2, a second output part OP2, a second stabilization part SP2, a second inverter part IVP2, and a second dummy input part DIP2. Unlike the i-th first stage STi, the g-th second stage BSTg may not include the sensing line selection part SLP.

The second reset part RP2, the second input part IP2, the second output part OP2, the second stabilization part SP2, the second inverter part IVP2, and the second dummy input part DIP2 may have the same structure and operation as the first reset part RP1, the first input part IP1, the first output part OP1, the first stabilization part SP1, the first inverter part IVP1, and the first dummy input part DIP1.

The second reset part RP2 may initialize the BQ node BQg.

The second input part IP2 may charge the BQ node BQg in response to the (g−1)-th second carry signal (BCRg−1) and may discharge the BQ node BQg in response to the (g+1)-th second carry signal (BCRg+1).

The first clock signal BCK1 and the second clock signal BCK2 may have phases opposite to each other. In one embodiment, for example, the activation period of each of the first clock signal BCK1 and the second clock signal BCK2 may be 7H period. The activation period of the first clock signal BCK1 and the activation period of the second clock signal BCK2 do not overlap each other and may be spaced by 1H period.

The first clock signal BCK1 may include a first sub clock signal BC_CK1 and a second sub clock signal BR_CK1. Although not shown, like the first clock signal BCK1, the second clock signal BCK2 may include a first sub clock signal and a second sub clock signal.

The second output part OP2 may receive the first sub clock signal BC_CK1 and the second sub clock signal BR_CK1. The second output part OP2 may operate in the same manner as the first output part OP1 described above. In one embodiment, for example, the second output part OP2 may receive the first sub clock signal BC_CK1 and the second sub clock signal BR_CK1, may boost the voltage charged to the BQ node BQg, and may output the g-th second scan signal BSCg and the g-th second carry signal BCRg.

A configuration for outputting the g-th second scan signal BSCg and the g-th second carry signal BCRg of the second output part OP2 may be the same as a configuration for outputting the i-th write scan signal SCi and the i-th sampling scan signal SSi of the first output part OP1.

However, the disclosure is not limited thereto. The configuration for outputting the g-th second scan signal BSCg and the g-th second carry signal BCRg of the second output part OP2 may be the same as a configuration for outputting the i-th write scan signal SCi and the i-th first carry signal CRi of the first output part OP1. The configuration of the second output part OP2 may be substantially the same as that of the first output part OP1 except that only the number of output signals is different.

The second stabilization part SP2 may discharge an output terminal of the g-th second scan signal BSCg and an output terminal of the g-th second carry signal BCRg to be stabilized. A configuration for discharging the output terminal of the g-th second scan signal BSCg and the output terminal of the g-th second carry signal BCRg of the second stabilization part SP2 may be the same as the configuration for discharging the output terminal of the i-th write scan signal SCi and the output terminal of the i-th sampling scan signal SSi of the first stabilization part SP1.

However, the disclosure is not limited thereto. The configuration for discharging the output terminal of the g-th second scan signal BSCg and the output terminal of the g-th second carry signal BCRg of the second stabilization part SP2 may be the same as the configuration for discharging the output terminal of the i-th write scan signal SCi and the output terminal of the i-th first carry signal CRi of the first stabilization part SP1. The configuration of the second stabilization part SP2 may be substantially the same as that of the first stabilization part SP1 except that the number of signals for discharging an output terminal is different.

The second inverter part IVP2 may invert voltages of the BQ node BQg and the BQB node BQBg. The second dummy input part DIP2 may provide the third signal S3 to the BQB node BQBg.

In accordance with the above-described operation, second scan signals (BSCg−1, BSCg, BSCg+1, . . . , BSCk) may be generated in synchronization with the first and second clock signals BCK1 and BCK2.

Figure 22:
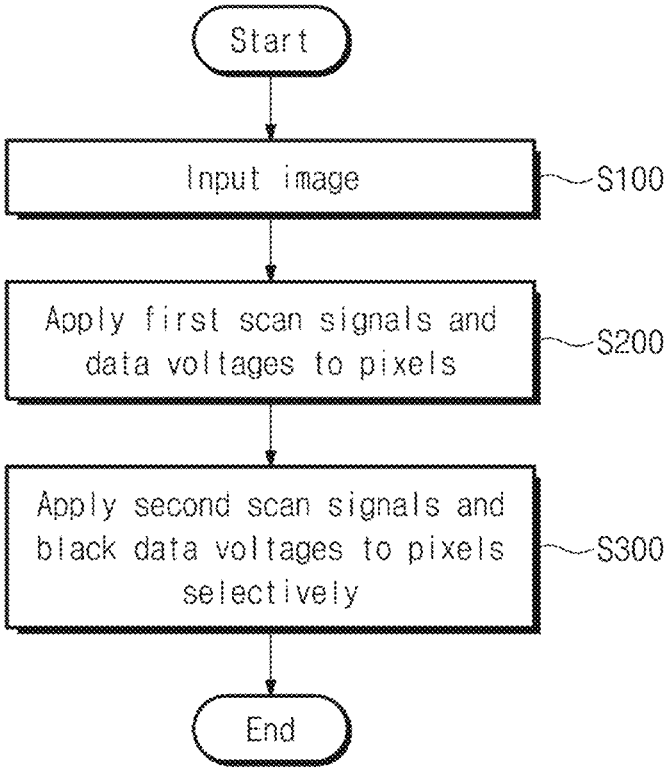
FIG. 22 is a flowchart for describing a method of driving a display device, according to an embodiment of the disclosure.
Figure 23:
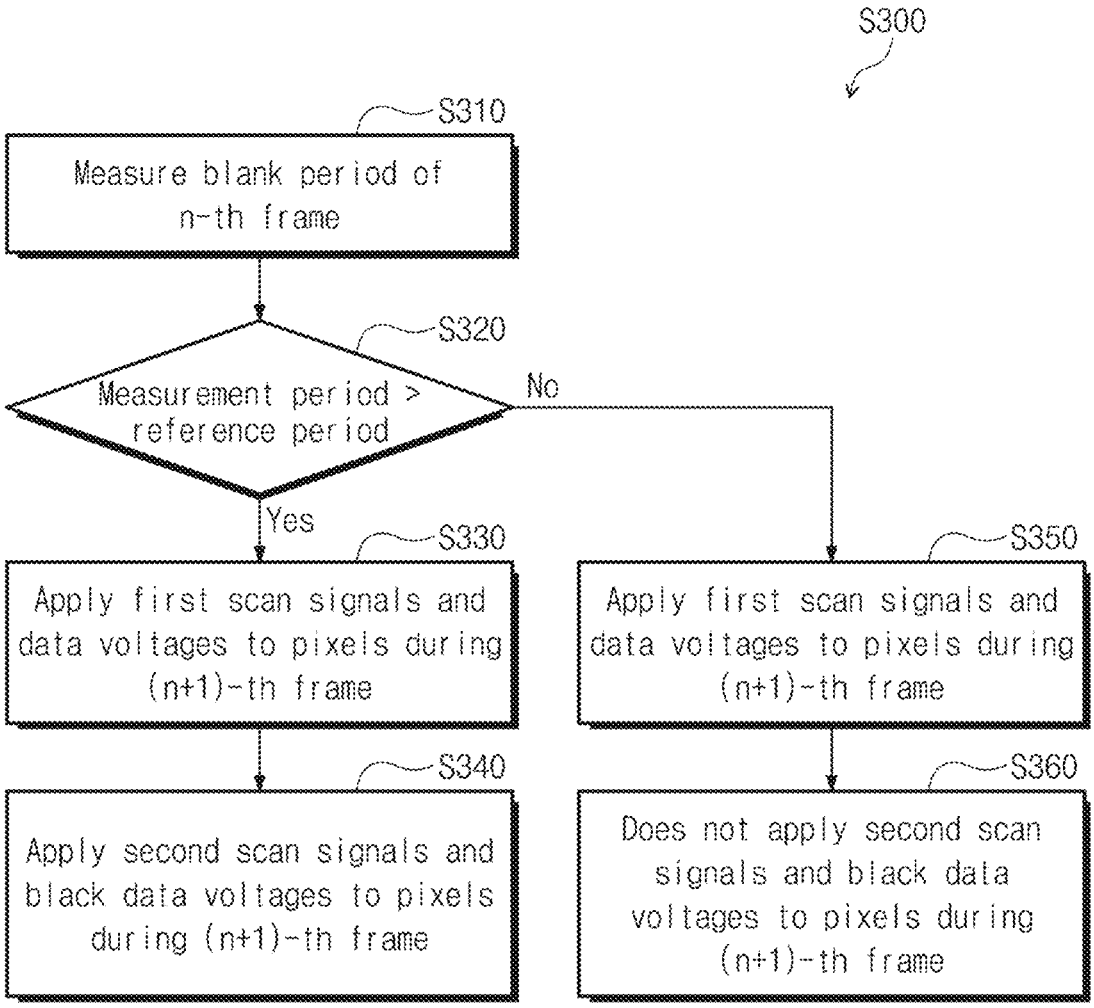
FIG. 23 is a detailed flowchart of operation 300 shown in FIG. 22.
Figure 24:
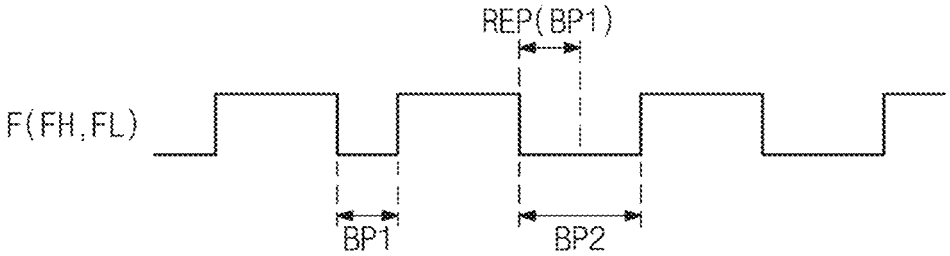
FIG. 24 is a diagram illustrating timing at which a frequency is changed.

FIG. 22 is a flowchart for describing a method of driving a display device, according to an embodiment of the disclosure. FIG. 23 is a detailed flowchart of operation S300 shown in FIG. 22. FIG. 24 is a diagram illustrating timing at which a frequency is changed.

Referring to FIG. 22, in an embodiment of a method of driving a display device DD, an image is input (S100). In such an embodiment, the first scan signals (SC1 to SCm, SS1 to SSm) and the data voltages Vd may be applied to the pixels PX (S200). Accordingly, the pixels PX may emit light.

In such an embodiment, the second scan signals BSC1 to BSCk and the black data voltages BLD may be selectively applied to the pixels PX (S300). In one embodiment, for example, the second scan signals BSC1 to BSCk and the black data voltages BLD may not be applied to the pixels PX at the first frequency FH, but may be applied to the pixels PX at the second frequency FL.

Referring to FIGS. 23 and 24, the timing controller T-CON shown in FIG. 1 may detect a time point at which the first frequency FH is changed to the second frequency FL. In one embodiment, for example, the timing controller T-CON may compare a measurement period obtained by measuring the blank period of an n-th frame (or a current frame) with a reference period REP (S310). The reference period REP may be set to the same period as the first blank period BP1.

In such an embodiment, the timing controller T-CON may compare the measurement period and the reference period REP (S320). When the measurement period is the second blank period BP2, the measurement period may be greater than the reference period REP. In this case, the timing controller T-CON may recognize an operating frequency as the second frequency FL that is a low frequency. During a (n+1)-th frame (or the next frame), the timing controller T-CON may selectively output the second control signal SCS2 depending on the comparison result between the measurement period and the reference period REP.

When the measurement period is greater than the reference period REP, the timing controller T-CON may output the second control signal SCS2 to the second stages BST1 to BSTk. Accordingly, the second stages BST1 to BSTk may output the second scan signals BSC1 to BSCk.

When the measurement period is greater than the reference period REP (YES), the first scan signals (SC1 to SCm, SS1 to SSm) and the data voltages Vd may be applied to the pixels PX during the (n+1)-th frame (or the next frame) (S330). Next, the second scan signals (BSC1 to BSCk) and the black data voltages BLD may be applied to the pixels PX during the (n+1)-th frame (or the next frame) (S340).

When the measurement period is the same as the reference period REP (NO), the timing controller T-CON may recognize an operating frequency as the first frequency FH that is a high frequency. When the measurement period is the same as the reference period REP, the timing controller T-CON may not output the second control signal SCS2 to the second stages BST1 to BSTk. Accordingly, the second stages BST1 to BSTk may not output the second scan signals BSC1 to BSCk.

When the measurement period is the same as the reference period REP (NO), the first scan signals (SC1 to SCm, SS1 to SSm) and the data voltages Vd may be applied to the pixels PX during the (n+1)-th frame (or the next frame) (S350). Next, the second scan signals (BSC1 to BSCk) and the black data voltages BLD may not be applied to the pixels PX during the (n+1)-th frame (or the next frame) (S360).

Due to this operation, the luminance of the pixels PX driven at the second frequency FL that is a low frequency may be reduced. Accordingly, a luminance difference between the pixels PX driven at the first frequency FH, which a high frequency, and the pixels PX driven at the second frequency FL may be reduced.

According to embodiments of the disclosure, when an operating frequency is changed from a high frequency to a low frequency, the luminance of pixels driven at the low frequency may be reduced. Accordingly, a luminance difference between pixels driven at the high frequency and a luminance difference between pixels driven at the low frequency may be reduced. As a result, display quality may be improved.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A display device comprising:

a plurality of pixels connected to a plurality of first scan lines, a plurality of second scan lines, and a plurality of data lines, wherein the pixels are arranged in a plurality of rows;

a plurality of first stages connected to the first scan lines;

a plurality of second stages connected to the second scan lines; and a data driver connected to the data lines, wherein each of the first scan lines is connected to pixels arranged in a corresponding row among the rows, wherein each of the second scan lines is commonly connected to pixels arranged in corresponding 8h rows among the plurality of rows, wherein h is a natural number, wherein the first stages sequentially output a plurality of first scan signals in response to a first control signal, wherein the second stages sequentially output second scan signals in response to a second control signal, which is different from the first control signal, and wherein a first second scan signal among the second scan signals, which is applied to pixels in a first to an 8h-th rows, is output in synchronization with a falling edge of a first scan signal, which is applied to pixels in the 8h-th row, among the first scan signals.

2. The display device of claim 1, wherein the number of the second scan lines is smaller than the number of the first scan lines, and wherein the second scan lines are commonly connected to pixels sequentially in units of 8h rows in the rows.

3. The display device of claim 1, wherein an activation period of each of the first scan signals is 2H period, wherein the activation period of an (i+1)-th first scan signal overlaps the activation period of an i-th first scan signal by 1H period, wherein an activation period of each of the second scan signals is 7H period, wherein the activation period of a (g+1)-th second scan signal is apart from the activation period of a g-th second scan signal by 1H period, and wherein each of g and i is a natural number.

4. The display device of claim 1, further comprising:

a timing controller which outputs the first control signal and the second control signal, wherein the pixels are driven during a plurality of frames, each of which has a display period and a blank period, and wherein the timing controller compares a measurement period, which is obtained by measuring a blank period of a n-th frame among the frames, with a reference period, and selectively outputs the second control signal during a (n+1)-th frame among the frames based on a result of a comparison of the measurement period with the reference period.

5. The display device of claim 4, wherein, when the measurement period is greater the reference period, the timing controller outputs the second control signal.

6. The display device of claim 4, wherein, when the measurement period is equal to the reference period, the timing controller does not output the second control signal.

7. The display device of claim 4, wherein the pixels are operated at a first frequency and a second frequency lower than the first frequency, wherein a first frame, which has the first frequency, among the frames includes:

a first display period; and a first blank period, and wherein a second frame, which has the second frequency, among the frames includes:

a second display period having a same period as the first display period; and a second blank period longer than the first blank period.

8. The display device of claim 7, wherein the reference period is set as a period equal to the first blank period.

9. The display device of claim 1, wherein the pixels emit light by receiving data voltages through the data lines in response to the first scan signals and are turned off by receiving black data voltages in response to the second scan signals.

10. The display device of claim 9, wherein each of the pixels includes a light emitting element which emits light by receiving a first voltage and a second voltage lower than the first voltage, and wherein the black data voltages have a level equal to a level of the second voltage.

11. The display device of claim 10, wherein the first scan signals include write scan signals and sampling scan signals, and wherein each of the pixels further includes:

a driving element including a first electrode which receives the first voltage, a second electrode connected to an anode of the light emitting element, and a control electrode connected to a first node;

a capacitor including a first electrode connected to the first node and a second electrode connected to the anode;

a first switching element including a first electrode connected to a corresponding data line among the data lines, a second electrode connected to the first node, and a control electrode which receives a corresponding write scan signal among the write scan signals;

a second switching element including a first electrode connected to a reference line, a second electrode connected to the anode, and a control electrode which receives a corresponding sampling scan signal among the sampling scan signals; and a third switching element including a first electrode connected to the first node, a second electrode which receives the second voltage, and a control electrode which receives a corresponding second scan signal among the second scan signals.

12. The display device of claim 1, wherein each of the first stages includes:

a sensing line selection part which charges a carry signal selected in response to a first signal and is connected to a Q node in response to a second signal;

a first input part which charges the Q node in response to a carry signal of a previous first stage and discharges the Q node in response to a carry signal of a next first stage;

a first output part which boosts a voltage charged at the Q node in response to the first control signal and outputs a first scan signal of a current first stage;

a first inverter part which inverts voltages of the Q node and a QB node with each other; and a first stabilization part which discharges an output terminal of the first scan signal in response to the voltage of the QB node.

13. The display device of claim 12, wherein each of the second stages includes:

a second input part which charges a BQ node in response to a carry signal of a previous second stage and to discharge the BQ node in response to a carry signal of a next second stage;

a second output part which boosts a voltage charged at the BQ node in response to the second control signal and outputs a second scan signal of a current second stage;

a second inverter part which inverts voltages of the BQ node and a BQB node with each other; and a second stabilization part which discharges an output terminal of the second scan signal in response to the voltage of the BQB node.

14. The display device of claim 13, wherein the second input part, the second output part, the second inverter part, and the second stabilization part have a same structure as the first input part, the first output part, the first inverter part, and the first stabilization part, respectively.

15. A driving method of a display device, the method comprising:

applying first scan signals and data voltages to pixels of the display device, wherein the first scan signals are sequentially output in response to a first control signal; and selectively applying second scan signals and black data voltages to the pixels, wherein the second scan signals are sequentially output in response to a second control signal, which is different from the first control signal, wherein the pixels are arranged in a plurality of rows, wherein a first second scan signal among the second scan signals, which is applied to pixels in a first to an 8h-th rows, is output in synchronization with a falling edge of a first scan signal, which is applied to pixels in the 8h-throw, among the first scan signals, wherein h is a natural number, wherein the pixels are driven during a plurality of frames, each of which has a display period and a blank period, and wherein the selectively applying the second scan signals and the black data voltages to the pixels comprises:

measuring a blank period of an n-th frame;

comparing a measurement period obtained by measuring the blank period with a reference period; and selectively applying the second scan signals and the black data voltages to the pixels during a (n+1)-th frame based on a result of the comparing.

16. The method of claim 15, wherein the pixels are connected to a plurality of first scan lines which receives the first scan signals, a plurality of second scan lines which receives the second scan signals, and a plurality of data lines which receives the data voltages, and wherein each of the first scan lines is connected to pixels arranged in a corresponding row among the rows, and wherein each of the second scan lines is commonly connected to pixels arranged in corresponding 8h rows among the plurality of rows.

17. The method of claim 15, wherein the selectively applying the second scan signals and the black data voltages to the pixels based on the result of the comparing includes:

when the measurement period is greater than the reference period, applying the second scan signals and the black data voltages to the pixels; and when the measurement period is equal to the reference period, not applying the second scan signals and the black data voltages to the pixels.

18. The method of claim 17, wherein the pixels are operated at a first frequency and a second frequency lower than the first frequency, wherein a first frame, which has the first frequency, among the frames includes:

a first display period; and a first blank period, wherein a second frame, which has the second frequency, among the frames includes:

a second display period having a same period as the first display period; and a second blank period longer than the first blank period, and wherein the reference period is set as a period equal to the first blank period.

19. The method of claim 15, wherein an activation period of each of the first scan signals is 2H period, wherein the activation period of an (i+1)-th first scan signal overlaps the activation period of an i-th first scan signal by 1H period, wherein an activation period of each of the second scan signals is 7H period, wherein the activation period of a (g+1)-th second scan signal is apart from the activation period of a g-th second scan signal by 1H period, and wherein each of g and i is a natural number.

* * * * *